US005491052A

United States Patent [19]

Van Meter et al.

[11] Patent Number: 5,491,052

[45] Date of Patent: Feb. 13, 1996

[54] YELLOW LAYER FOR COLOR PHOTOGRAPHIC ELEMENTS

[75] Inventors: James P. Van Meter, Rochester; Pranab Bagchi, Webster; Brian Thomas, Pittsford; Thomas A. Rosiek, Honeoye Falls, all of N.Y.

[73] Assignee: Eastman Kodak Company, Rochester, N.Y.

[21] Appl. No.: 477,723

[22] Filed: Jun. 7, 1995

Related U.S. Application Data

[60] Division of Ser. No. 148,125, Nov. 5, 1993, which is a continuation-in-part of Ser. No. 850,722, Mar. 13, 1992, abandoned.

[51] Int. Cl.[6] ..... G03C 7/388; G03C 7/396

[52] U.S. Cl. ..... 430/545; 430/546; 430/556; 430/557; 430/637; 430/638; 430/535

[58] Field of Search ..... 430/556, 557, 430/546, 545, 638, 377, 935, 637, 388, 389; 427/162

[56] References Cited

U.S. PATENT DOCUMENTS

| | | | |
|---|---|---|---|
| 3,860,425 | 1/1975 | Ono et al. | 430/546 |
| 4,291,113 | 9/1981 | Minamizono et al. | 430/546 |
| 4,656,125 | 4/1987 | Renner et al. | 430/551 |
| 4,791,050 | 12/1988 | Ogawa et al. | 430/557 |
| 4,970,139 | 11/1990 | Bagchi et al. | 430/546 |
| 5,013,640 | 5/1991 | Bagchi et al. | 430/546 |
| 5,100,771 | 3/1992 | Mihayashi et al. | 430/546 |

FOREIGN PATENT DOCUMENTS

| | | |
|---|---|---|
| 019800 | 5/1980 | European Pat. Off. . |
| 379893 | 1/1990 | European Pat. Off. . |
| 149719 | 3/1980 | Germany . |

*Primary Examiner*—Lee C. Wright
*Attorney, Agent, or Firm*—Andrew J. Anderson

[57] ABSTRACT

It has been discovered that when polyalkylene oxide compounds or block polymeric or block oligomeric surface active compounds comprising at least a polyoxypropylene (POP) block and a polyoxyethylene (POE) block are added to conventional dispersions of yellow couplers (that is dispersions in which the dispersed particles have a particle size of 0.1 to 0.6 μm), such dispersions in a coated silver halide photographic element produce substantially higher dye yield compared to the conventional dispersion without any additive. Further, the yellow dye formed from such dispersions containing the addenda of this invention are substantially more light stable compared to dispersions that does not contain such addenda.

The invention is carried out just by adding required amounts of the said polyoxyethylene (POE)—polyoxypropylene (POP) compound to a preformed milled coupler dispersion prior to coating the photographic element.

4 Claims, 5 Drawing Sheets

YELLOW LAYER FOR COLOR PHOTOGRAPHIC ELEMENTS

This application is a Divisional of application Ser. No. 08/148,125 filed Nov. 5, 1993, which is a continuation-in-part of application Ser. No. 07/850,722 filed Mar. 12, 1992, now abandoned, the entire disclosure of which is incorporated herein by reference.

BACKGROUND OF THE INVENTION

1. Field of the Invention

This invention relates to color photographic elements and to a method of preparing the same. More particularly, it relates to photographic elements containing certain yellow coupler dispersions and silver halide having an unexpected increase in photographic activity of the yellow dispersion and also an unexpected increase of the stability of the developed yellow dye to light fade.

2. Description of Related Art

Ballasted photographic dye forming couplers are usually incorporated in photographic systems as a colloidal emulsion, usually called a dispersion in the photographic art. The various methods of preparation of photographic coupler dispersions of prior art are illustrated in FIG. 1. The coupler is added to a high boiling water immiscible solvent (called a permanent solvent) such as tricresyl phosphate, dibutyl phthalate, etc. Some times a low boiling water miscible solvent (called an auxiliary solvent) such as ethylacetate, propanol, methyl-isobutyl ketone, etc. is also added to promote the solubility of less soluble couplers. The mixture is heated to form a true crystal free solution, called the "coupler solution" as indicated in FIG. 1. A second solution of the stabilizing surfactant or surfactants is added to a mixture of gelatin and water and heated to produce a true solution called the "surfactant solution" as indicated in FIG. 1. The surfactant used in the "surfactant solution" is usually an anionic surfactant. The "surfactant solution" and the "coupler solution" are then mixed together with mild stirring to form what is known as a "premix". The premix consists of a crude emulsion of the oil phase (i.e., the "coupler solution") in the aqueous phase (i.e., the "surfactant solution"). The crude "dispersion" is composed of droplets of very large particles, of the order of 5–15 μm in diameter and is as such not usable for high quality photographic products. It is necessary to further reduce the particle size by subsequent high shear milling procedures. The crude "premix" is then further milled in an appropriate high shear milling device. If the coupler solution is composed of only "permanent" solvent, then the dispersion is directly usable in photographic product and such dispersions are usually called "direct dispersions". The particle size of such dispersions are generally broadly distributed with an average diameter between 0.1 to 0.6 μm. As direct dispersions do not contain any auxiliary solvents, no water miscible solvent removal is necessary, resulting in a relatively less expensive dispersion preparation process. Such direct dispersions are then appropriate for price sensitive high volume products such as various types of color papers.

When dispersions are prepared with auxiliary solvents an additional step is necessary to remove the water miscible solvent such that it does not evaporate during the cooling operations to cause excessive evaporation load or create an environmentally hazardous situation. Those dispersions that are treated by some type of an evaporation procedure to remove the auxiliary solvent under a controlled condition are called "evaporated" dispersions. Alternatively, the crude premix can be chill set and noodled by extrusion through orifices and washed by cold water to remove the water soluble auxiliary solvent. Dispersions prepared by this process are usually called "washed" dispersions. Washed dispersions are in general more expensive than evaporated dispersions as they may involve up to 50 hours of tedious washing procedures. Both "washed" and evaporated dispersions lead to dispersion droplets that have broad size distribution with mean diameters ranging between 0.1 to 0.6 μm. "Washed" and "evaporated" dispersions are usually suitable for low volume film products.

U.S. Pat. No. 3,860,425, issued Jun. 14, 1975 to Ono et al teaches the use of a mixture of (1) a nonionic surface active agent containing polyoxypropylene units having a molecular weight greater than 500 and polyoxyethylene units, and at a molar ratio of said polyoxyethylene units to the polyoxypropylene units ranging from 0.1 to 0.6 and (2) an anionic surface active agent having an $—OSO_3M$ group or an $—SO_3M$ group, wherein M represents a monovalent cation, and a hydrophobic group in the preparation of a milled dispersion of oleophilic materials, for photographic use. Such dispersions have particle diameters between 0.67 to 0.19 μm. Between about 0.05 to about 0.10 gram of the anionic surfactant and between about 0.02 gram to about 0.10 gram of the nonionic surfactant per gram of the oleophilic dispersed phase of the coupler are used.

U.S. Pat. No. 5,013,640, issued May 7, 1991 to Bagchi et al discloses the use of block oligomeric surfactants comprising hydrophobic polyoxyethylene block (A) and hydrophilic polyoxypropylene block (B) joined in the manner of A-B-A, B-A-B, A-B, $(A\text{-}B)_n{\cong}G{\cong}(B\text{-}A)_n$, a $(B\text{-}A)_n{\cong}G{\cong}(A\text{-}B)_n$, where G is a connector organic moiety and n is between 1 and 3, as melt addenda to reduce viscosity of a microprecipitated dispersion melt in gelatin. The said microprecipitated dispersion being pre-precipitated as a slurry in water before gelatin addition using preferably an anionic surfactant. The particle size of the microprecipitated dispersions have diameters between 0.01 to 0.05 μm.

In cost sensitive high volume products, such as Ektacolor® Paper or Eastman Color Print®, it is desirable to increase the dye yield of a coupler, as in such a case, it requires less coupler and/or silver, which translates to cost reduction. Further, cyan, magenta and yellow dyes that create photographic images, fade with time when exposed to various ambient lighting conditions such as sunlight, incandescent light or fluorescent light. Most damage is usually done by UV-radiation that may be present in any lighting source. It is therefore desirable to make photographic products, especially photographic paper that is used to display images of both personal and commercial scenes, as stable as possible to fade. There are various means of achieving improved dye stability. One way is to produce couplers that form dye with increased dye stability. Since products such as Ektacolor® Paper or Eastman Color Print® are high volume products that are highly price sensitive, it is not always commercially feasible to replace an existing coupler with settled down cost with a new coupler. Photographic papers contain a layer comprising a UV-absorbing compound dispersed in protective layers to absorb the damaging UV-radiation and prevent it from reaching the image dyes. Usually such UV-absorbing compounds have a slight yellow coloration, which when applied in large enough quantities cause the white areas of paper to appear yellow, which is highly undesirable. Therefore, there is a limit to the extent that such UV-absorptive materials can be applied in a photographic product such as paper. U.S. Pat. No. 4,656,125 issued Apr. 7, 1987, to Rinner et al discloses that dye stability can be achieved by the addition of stabilizer compounds to the coupler dispersions. A need to enhance the activity of photographic couplers and enhance the stability of image dyes from fade is desired.

In photographic paper where the image resides on a reflective support light passes through the photographic layers twice for the visualization of the image. In transparency display products such as Duratrans® light passes through the image only once. Therefore, to produce enough visual density the couplers and the silver halide emulsions are coated at about 70% higher levels on a transparent support. In such case, where the component loading is very high, the bottom yellow layer develops up much more slowly compared to the top cyan and the magenta layers. This requires the use of a longer development time. Therefore, a more active bottom yellow layer in such products with faster development rates will provide a much improved product with shorter development time. Therefore, there is need for the invention of a more active yellow dispersion melt.

SUMMARY OF THE INVENTION

An object of this invention is to provide more active, (one yielding more dye-density per unit lay down) yellow couplers, dispersed by conventional milling procedures by the simple addition of polyoxyalkylene compounds to the dispersion melt just prior to coating of a photographic product.

Another object of the invention is to provide more light-stable yellow dye-forming coupler dispersion melts for quality improvement of photographic products such as color papers and color display materials.

Another objective of this invention is to provide a multilayer photographic package, where the bottom slow-developing yellow layer is more active.

It has been discovered, quite unexpectedly, that when a polymeric, polyoxyalkylene surface active compound is added to a conventional dispersion of a yellow coupler (that is a dispersion having dispersed particles of yellow coupler in which the particle size is 0.1 to 0.6 μm), such dispersion in a coated silver halide photographic element produces substantially higher dye yield compared to a conventional dispersion without any additive. Further, the yellow dye formed from such a dispersion containing a surface active agent in accordance with this invention are substantially more light stable compared to dispersions that do not contain such addenda.

One aspect of this invention comprises a color photographic recording element comprising at least one blue-sensitive photographic silver halide emulsion layer comprising dispersed particles having a particle size of 0.1 to 0.6 μm and comprising a yellow image-dye forming coupler having the formula:

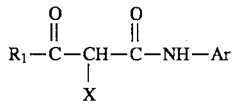

wherein $R_1$ is substituted or unsubstituted alkyl, substituted or unsubstituted aryl, substituted or unsubstituted anilino or substituted or unsubstituted heterocyclic; Ar is substituted or unsubstituted aryl; and X is hydrogen or a coupling-off group; and from about 0.1 to about 0.6 gram of a polyoxyalkylene polymer, per gram of the yellow coupler.

Another aspect of this invention comprises a method of preparing a blue sensitive layer in a silver halide photographic light sensitive element, which method comprises (i) forming a dispersion comprising dispersed particles in an aqueous medium containing a hydrophilic colloid, the particles having a particle size of 0.1 to 0.6 μm and comprising a yellow image-dye forming coupler having the formula:

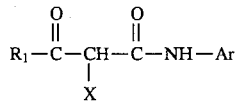

wherein $R_1$ is substituted or unsubstituted alkyl, substituted or unsubstituted aryl, substituted or unsubstituted anilino or substituted or unsubstituted heterocyclic; Ar is substituted or unsubstituted aryl; and X is hydrogen or a coupling-off group;

(ii) adding a polyoxyalkylene polymer in an amount of about 0.1 to about 0.6 gram, per gram of the yellow coupler in the dispersion; and (iii) mixing the dispersion with a silver halide emulsion;

(iv) applying the resulting composition onto a support to form a layer.

DESCRIPTION OF PREFERRED EMBODIMENTS

Figure 1:
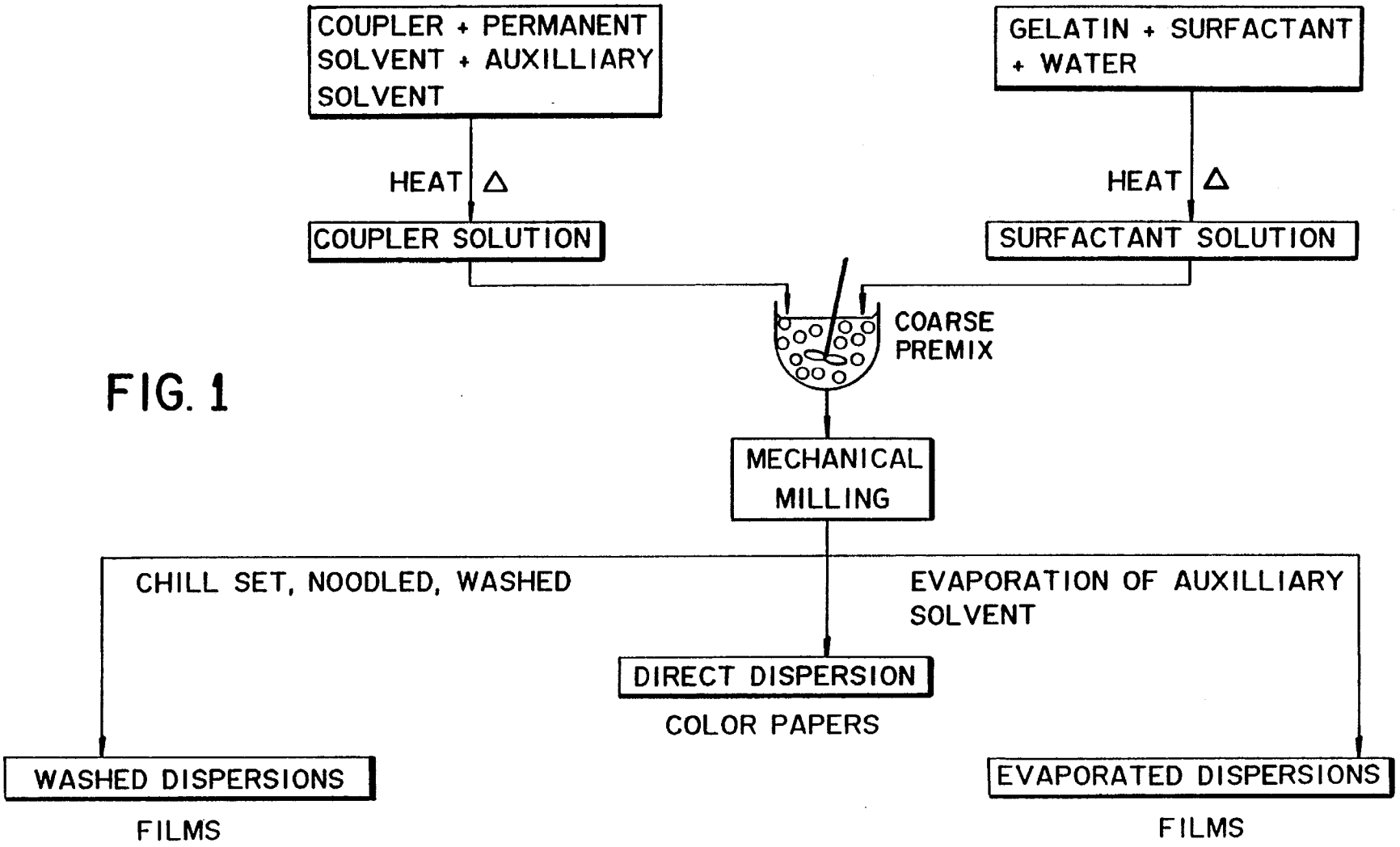
FIG. 1 is a diagrammatic flow chart illustrating prior art procedures for the preparation of conventional milled dispersions.

The methods of preparation of conventional milled dispersions of photographic dye-forming couplers have been extensively described earlier. In the method and composition of this invention, the surfactant used to prepare the surfactant solution of FIG. 1 is any surfactant that will aid the formation of stable dispersions of particles.

Such surfactants for the preparation of the dispersion can be anionic and are in general defined as follows:

Class—A: Anionic Dispersion Surfactants

The anionic dispersion surfactants of this invention comprise a 6 to 25 carbon atom hydrophobic moiety made up of either aliphatic, aromatic or of both types of hydrocarbons, or fluorocarbon groups terminated by single or multiple anionic charges arising from $—COO^-$, $—SO_3^-$ or $—OSO_3^-$ groups or a combination thereof.

Typical examples of such "Class-A Anionic Dispersion Surfactants" are as follows:

| | | |
|---|---|---|
| DS-A1 | $CH_3-(CH_2)_{11}-OSO_3^-Na^+$ | (Sodium Dodecyl Sulfate) |
| DS-A2 | 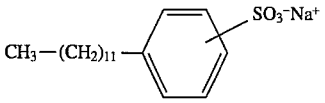 | (Sodium Dodecyl Benzene Sulfonate) |
| DS-A3 | 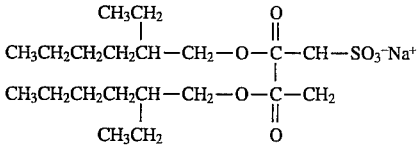 | (Aerosol OT, Cynamid) |
| DS-A4 | 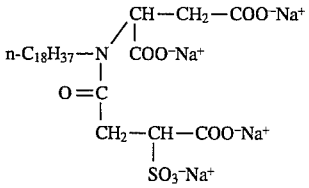 | (Aerosol 22, Cynamid) |
| DS-A5 | 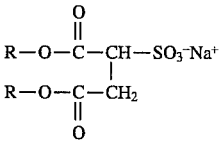 | (Aerosol MA, Cynamid) |
| | where $R = -CH(CH_3)C_4H_9$ | |
| DS-A6 | " | 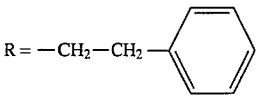 |
| DS-A7 | " | 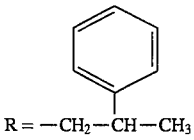 |
| DS-A8 | " | $R = -CH_2-CH(CH_2CH_3)C_3H_7$ |
| DS-A9 | 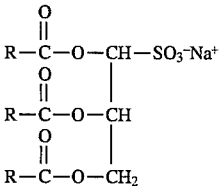 | $R = -(CH_2)_nCH_3$ (n = 2, 3 & 5) |
| DS-A10 | " | 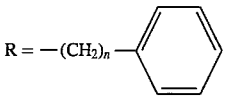 (n = 2 to 5) |
| DS-A11 | 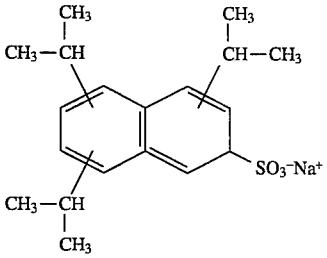 | (Alkanol-XC, Du Pont) |

-continued

| | |
|---|---|
| DS-A12 | 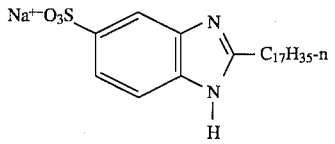 |
| DS-A13 | 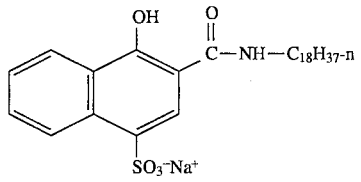 |
| DS-A14 | $Na^{+-}O_3S-CH(CH_2-COO-C_8H_{17}\text{-}n)-COO-C_8H_{17}\text{-}n$ |

Such surfactants for the preparation of the dispersions can also be polyether surfactants definable as follows:

Class—B: Polyether Dispersion Surfactants

The polyether dispersion surfactants of this invention comprise a 6 to 25 carbon atom hydrophobic moiety made up of either aliphatic, aromatic or of both types of hydrocarbon or fluorocarbon groups and at least 2 oxyethylene and/or glycidyl ether groups that may or may not be terminated with a single or multiple negative change arising from —$COO^-$, —$SO_3^-$, or —$OSO_3^-$ groups or a combination thereof.

Typical examples of such "Class-B Polyether Dispersion Surfactants" are as follows:

Class—C: Sugar Dispersion Surfactants

The sugar dispersion surfactants of this invention are characterized by having one to three hydrophobic tails, each tail containing from about 6 to 25 carbon atoms comprising either aliphatic, aromatic or a combination of both types of hydrocarbon or fluorocarbon groups and also having one or more attached hydrophilic mono- or oligosacharidic hydrophilic chains that may or may not be terminated by single or multiple anionic charges arising from —$COO^-$, —$OSO_3^-$ or —$SO_3^-$ groups or a combination thereof.

Typical examples of such "Class —C Sugar Dispersion Surfactants" are as follows:

| | | |
|---|---|---|
| DS-B1 | 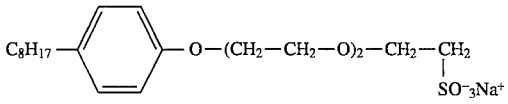 85% and 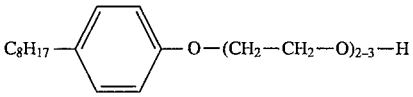 15% | (Tx200E, Eastman Kodak Company) |
| DS-B2 | 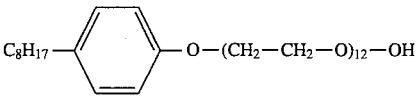 | (Triton X-102, Union Carbide) |
| DS-B3 | 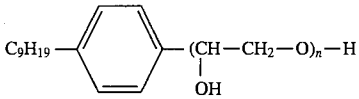 n = 5–12 (mixture) | (Olin 10G, Olin) |
| DS-B4 | $n\text{-}C_{12}H_{25}-O-(CH_2-CH_2-O)_{12}-SO_3^-Na^+$ | (Polystep B-23, Stepan) |
| DS-B5 | $n\text{-}C_{12}H_{25}-O-(CH_2-CH_2-O)_{23}-OH$ | (Trycol 5964, Henkel) |
| DS-B6 | $C_{10}H_{21}-O-(CH_2-CH_2-O)_{15}-CH_2$ <br> $Na^+\ ^-O_3S\ -CH_2$ | (Avanel S-150, PPG/Mazer) |

Such surfactants for the preparation of the dispersion can also be sugar surfactants defined as follows:

DS-C1
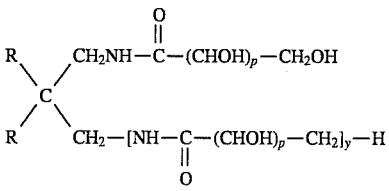
where p = 3 to 10; y = 0 or 1;
R = —$(CH_2)_n$H, where n = 0 to 10;
or
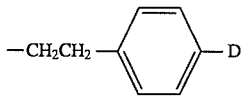
where D is H$(CH_2)_z$, and
z is 2–10.
DS-C2
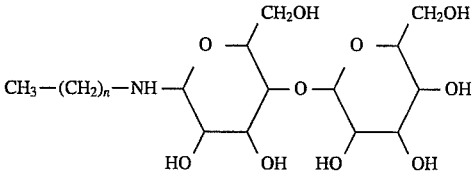
where, n = 3 to 15
DS-C3
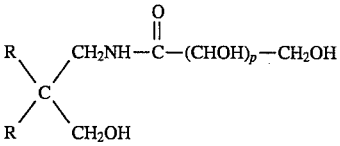
where, R = n-$CH_3$—$(CH_2)_x$— (where x = 3 to 10)
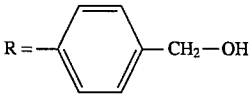
p = 3 to 15
DS-C4
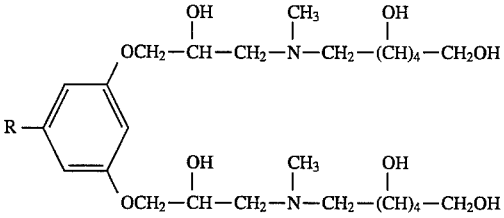
where R = $CH_3$—$(CH_2)_x$—
(where, x = 1 to 5)
DS-C5
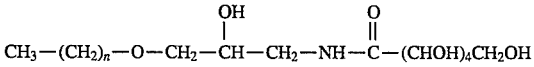
where n = 3 to 15
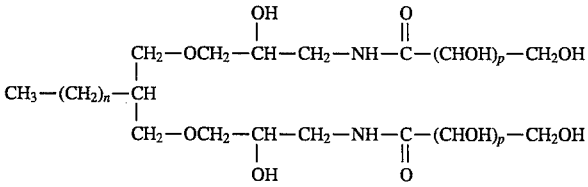
where, n = 2 to 12
p = 3 to 10

-continued
DS-C7
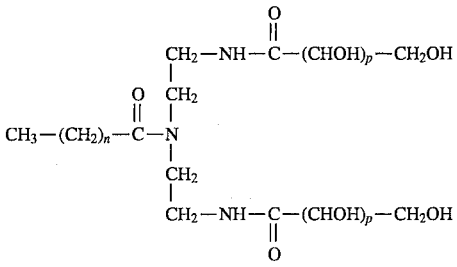
where, n = 6 to 18
p = 3 to 10
DS-C8
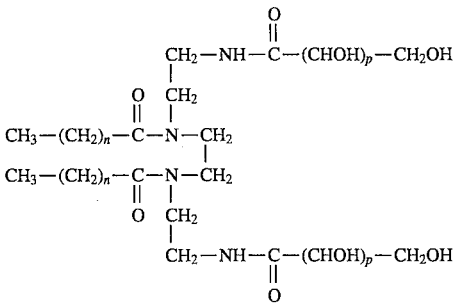
where, n = 2 to 18
p = 3 to 10
Alkyl Polyglycosides
DS-C9
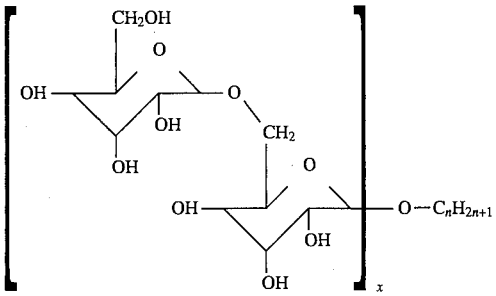
n is 8 to 14
APG 225 n is 8 and 10 and x = 1.8
APG 300 n is 9 and 11 and x = 1.4
APG 325 n is 9 and 11 and x = 1.6
APG 600FPn is 12 and 14 and x = 1.4
APG 625 n is 12 and 14 and x = 1.6
Sucrose Alkyl Esters
DS-C10
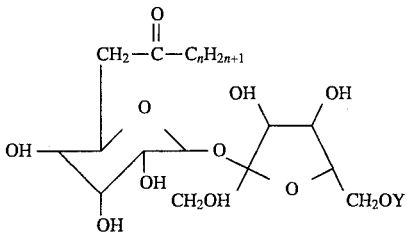
where n = 9 to 17
Y = —H or, $-\overset{O}{\overset{\|}{C}}-C_nH_{2n+1}$ -continued Sucrose Alkyl Amide and Ether

DS-C11

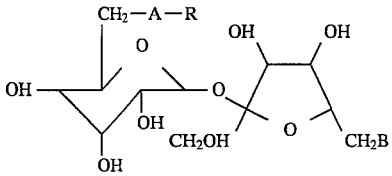

where n = 9 to 17 where R = $-C_{10}H_{21}$ to $-C_{18}H_{37}$ and $-A-$ is $-O-\overset{O}{\overset{\|}{C}}-NH-$ or $-O-$ and B is $-OH$ or $-A-R$

DS-C12

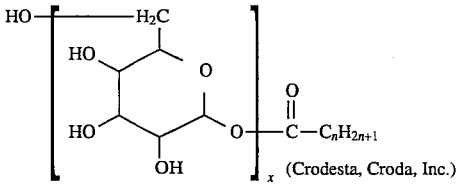

(Crodesta, Croda, Inc.)

wherein n = 5 to 20 and x = 1 to 4.

The dispersion surfactant or surfactants can be used by themselves or as any combination of mixtures of different classes or different individual surfactants at a level performing between about 0.03 g to about 0.1 g of total surfactant, as a single surfactant or in combination for the preparation of the dispersion per g of the coupler to be dispersed. The preferred surfactant is Alkanol-XC (DS-A11).

Other surfactants of class-A, B or C set forth in "McCutcheon's", Vol. 1, "Emulsifiers and Detergents", International Edition and North American Edition, McCutcheon's Division of the Manufacturing Confectioner Publishing Co., N.J. (1991), incorporated herein by reference, may be used.

As discussed above, the yellow coupler used in this invention has the formula:

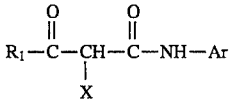

wherein $R_1$ is substituted or unsubstituted alkyl, substituted or unsubstituted aryl, substituted or unsubstituted anilino or substituted or unsubstituted heterocyclic; Ar is substituted or unsubstituted aryl; and X is hydrogen or a coupling-off group.

$R_1$ is preferably:

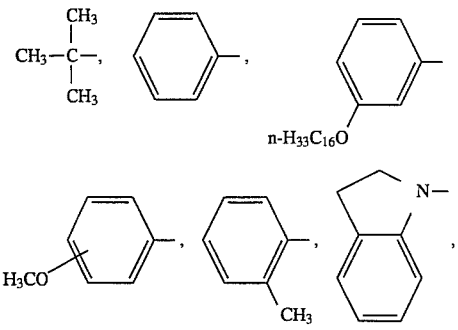

-continued

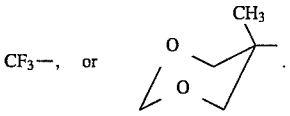

In particularly preferred embodiments of the invention $R_1$ is t-butyl or substituted phenyl.

Ar is preferably substituted phenyl wherein at least one substituent is halo, alkoxy or aryloxy. Ar preferably contains a ballasting group. Ballasting groups usually comprise one or more 5 to 25 carbon atom containing organic moieties whose function is to immobilize the coupler and the formed image dye during photographic development by imparting poor water diffusibility to the coupler compound. In preferred embodiments of the invention the ballasting group is:

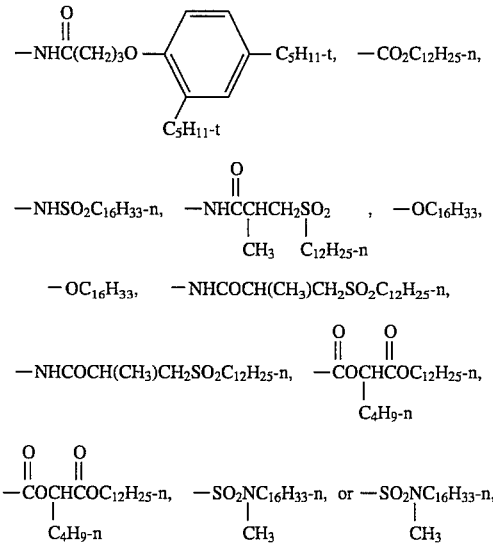

X is a hydrogen or a coupling-off group. Coupling-off groups are generally organic groups which are released during photographic processing. The released coupling-off group can be a photographically useful group. In preferred embodiments of this invention, X is: hydrogen, halogen,

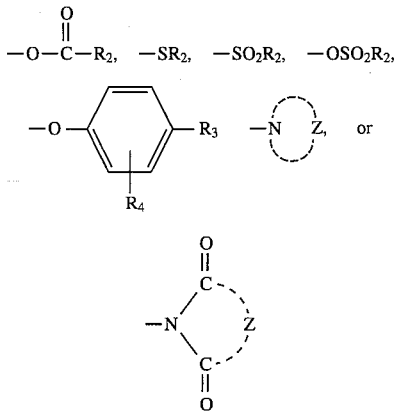

where $R_2$ is alkyl or aryl, $R_3$ is arylsulfonyl, alkylsulfonyl, alkoxycarbonyl, aryloxycarbonyl, cyano, acyl, acylamino, alkylsulfamoyl, arylsulfamoyl, alkylsulfonamido, arylsulfonamido, alkoxysulfonyl, aryloxysulfonyl, alkylcarbamoyl, arylcarbamoyl, carboxyl or nitro; and $R_4$ is hydrogen, halogen, alkyl, alkoxy, hydroxy, acylamino, alkylsulfonamido, arylsulfonamido, carboxyl or alkoxy carbonyl and Z is any organic moiety to complete the ring.

In preferred embodiments of the invention, $R_3$ is preferably carboxyl, phenylsulfonyl, optionally substituted with hydroxyl, aralkoxy or alkyl sulfamoyl, in which the alkyl substitutent can be substituted with halogen or hydroxyl and $R_4$ is preferably hydrogen, chlorine, bromine, methyl, ethyl, methoxy, hydroxy, acetamide, methanesulfonamido, benzenesulfonamido, carboxyl, methoxy, carbonyl or the like.

The ring structure

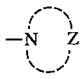

is preferably

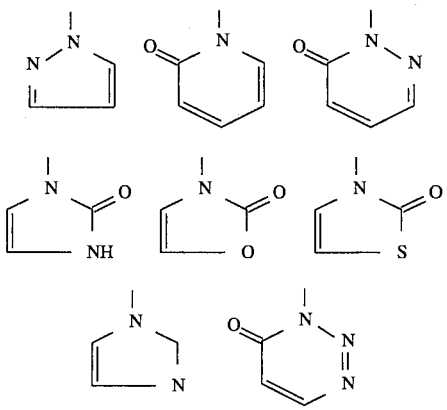

-continued

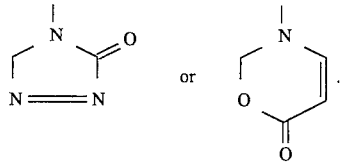

The ring structure

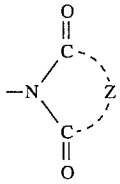

is preferably

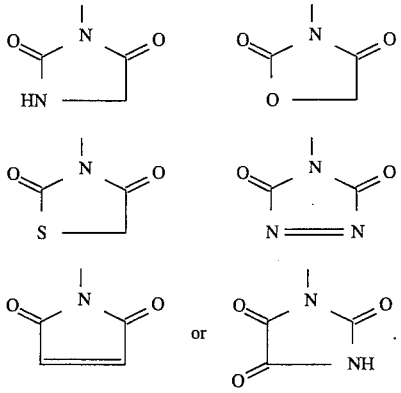

The ring structure can be substituted by alkyl, aryl, aralkyl, alkoxy, halogen, sulfonamido, sulfamoyl, carbamoyl, carboxy, hydroxy, nitro, cyano, alkenyl, etc.

Particularly preferred are yellow couplers of the of the pivalylacetanilide (PAA) class. Such couplers include compounds of the formula:

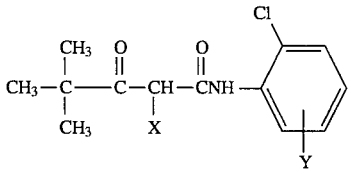

where X is a coupling-off group, and Y is a ballasting group.

Specific examples of yellow-dye forming couplers used in the photographic element of this invention are:

CY-1
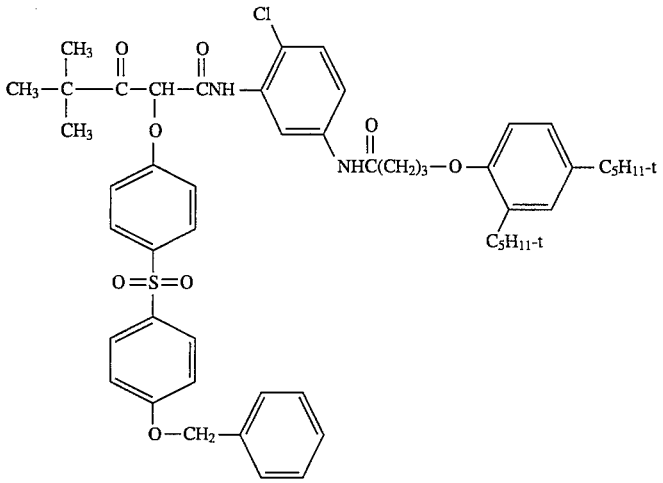
CY-2
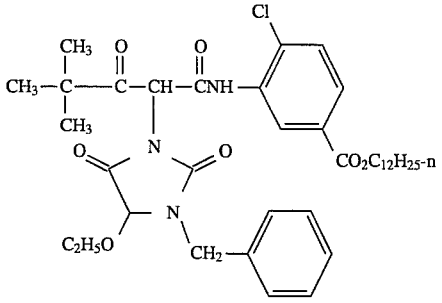
CY-3
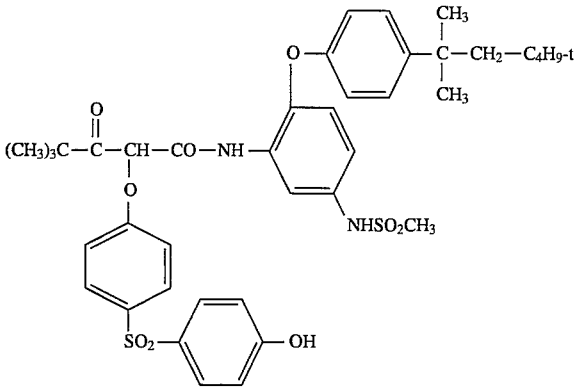
CY-4
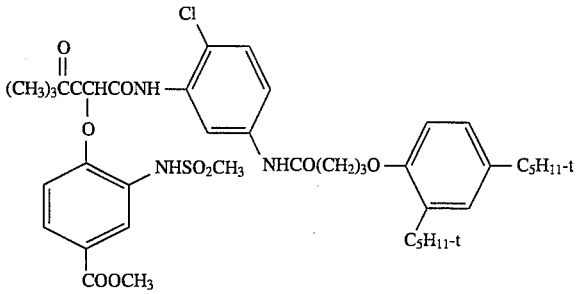

-continued
CY-5
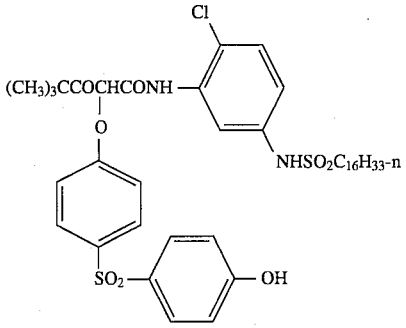
CY-6
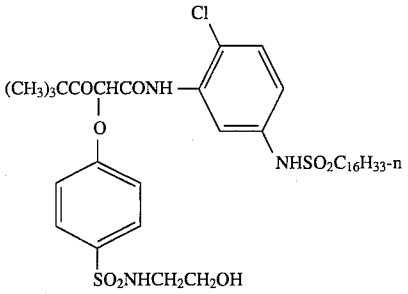
CY-7
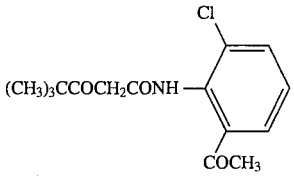
CY-8
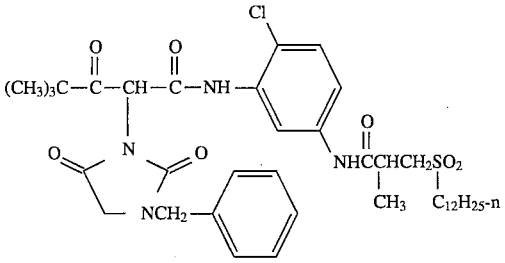
CY-9
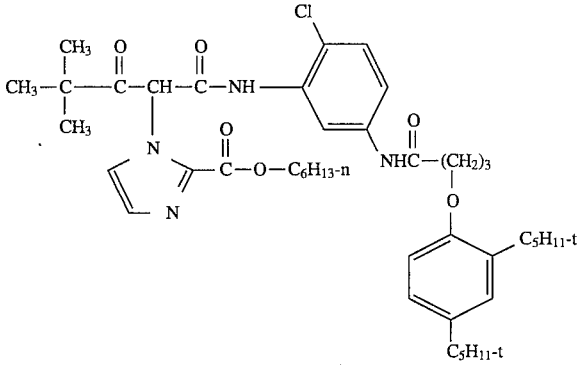
CY-10
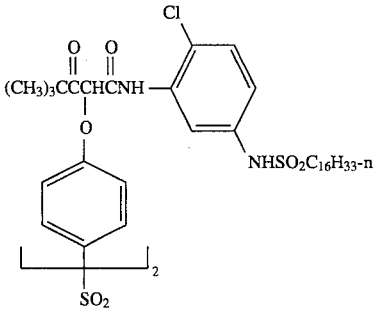
CY-11
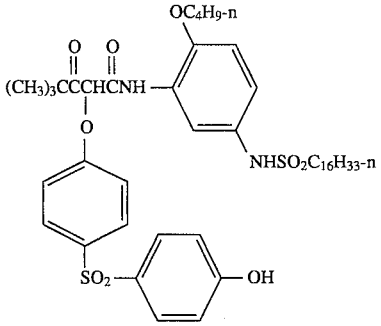
CY-12
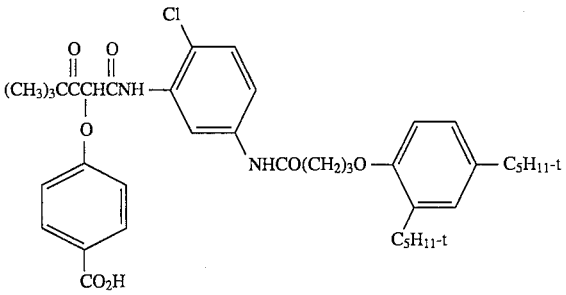

-continued
CY-13
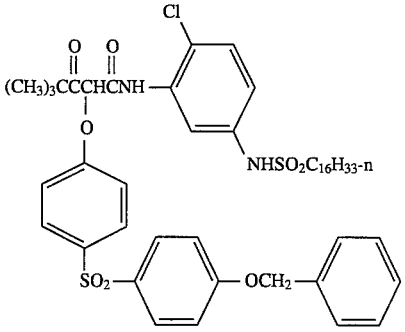
CY-14
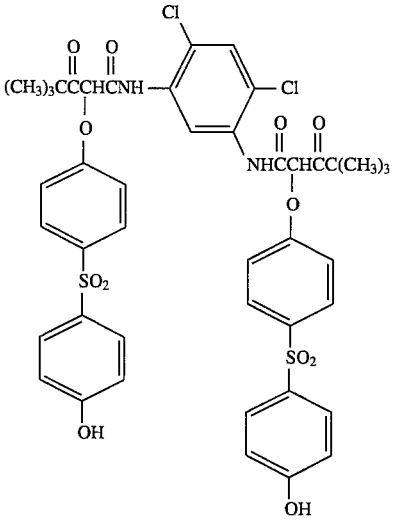
CY-15
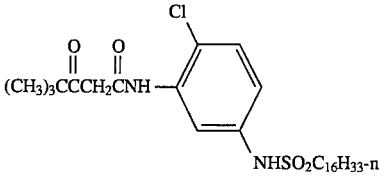
CY-16
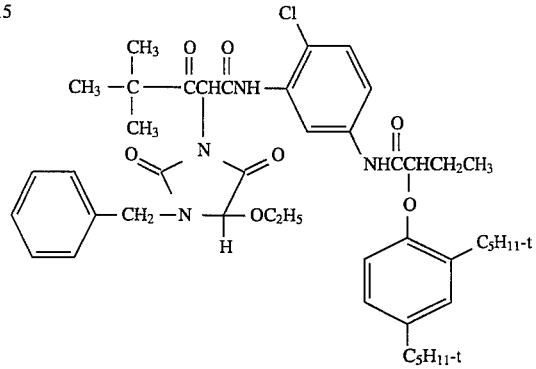
CY-17
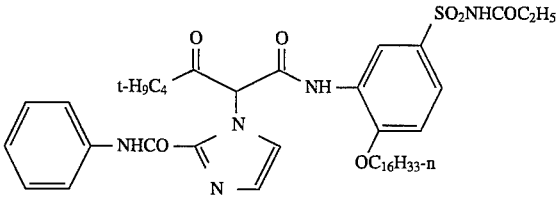
CY-18
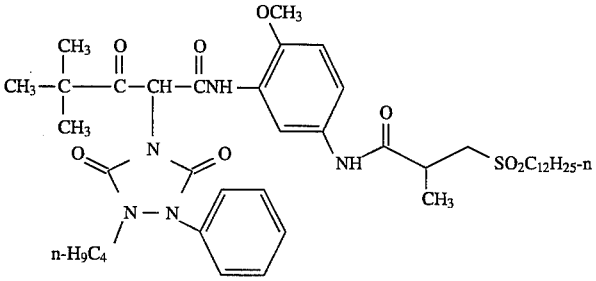

-continued
CY-19
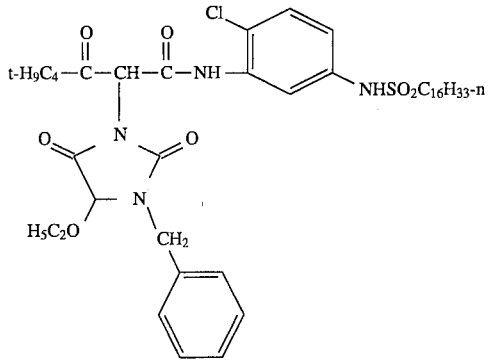
CY-20
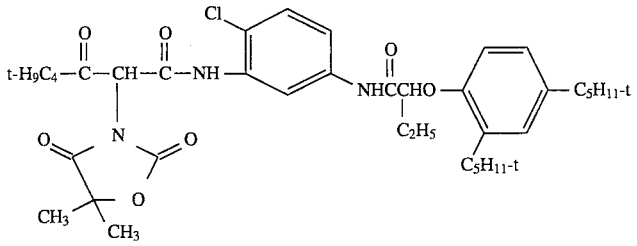
CY-21
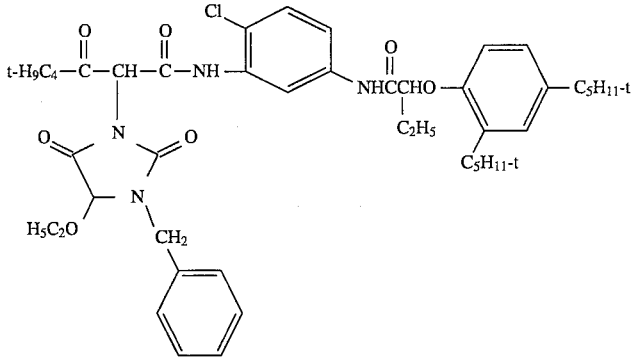
CY-22
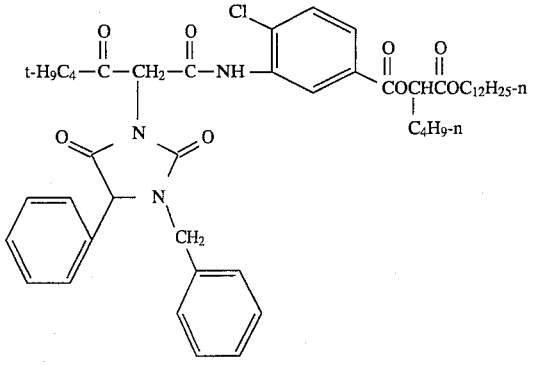
CY-23
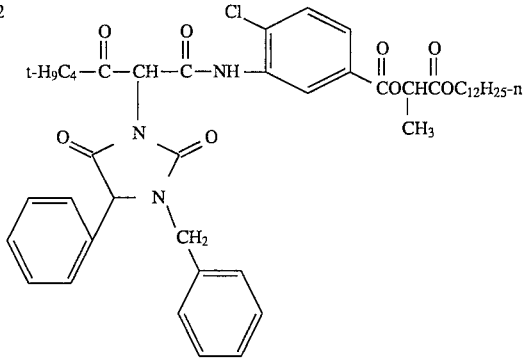
CY-24
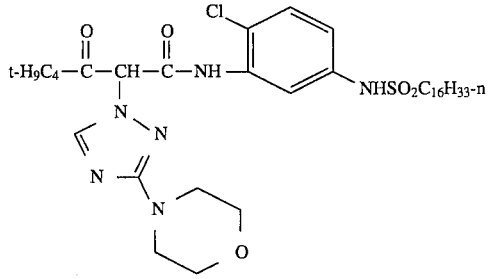

-continued
CY-25
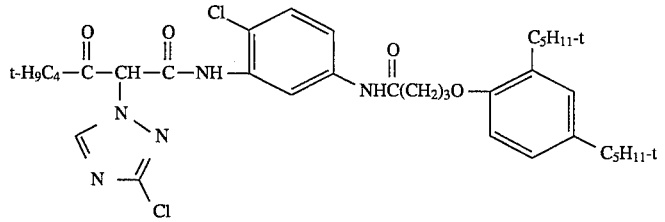
CY-26
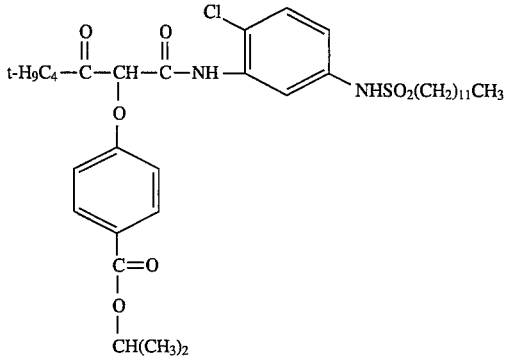
CY-27
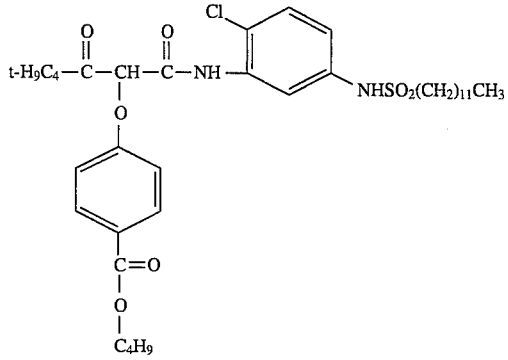
CY-28
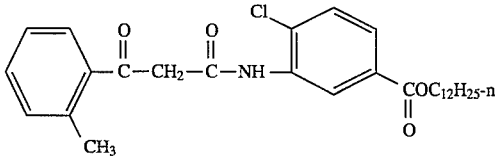
CY-29
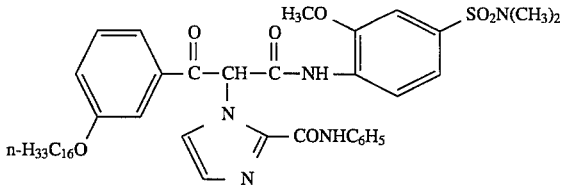
CY-30
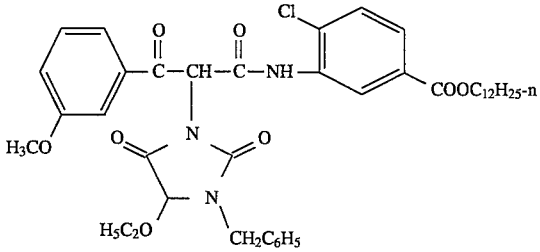
CY-31
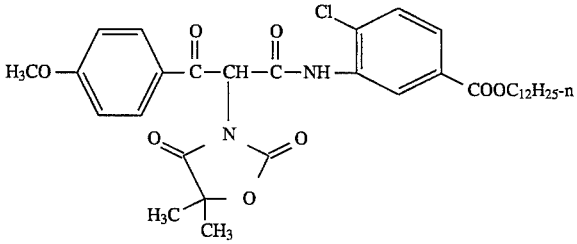

-continued
CY-32
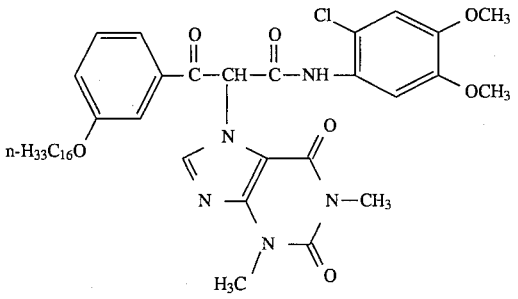
CY-33
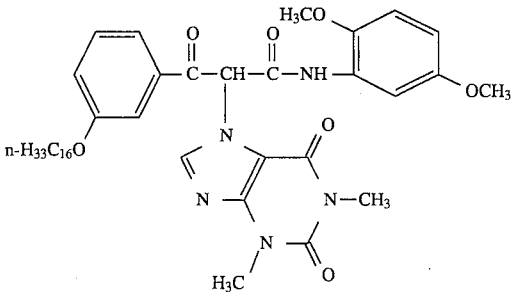
CY-34
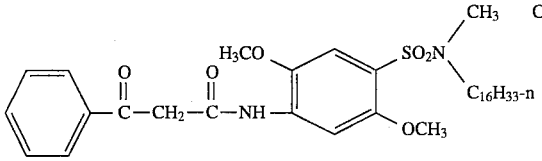
CY-35
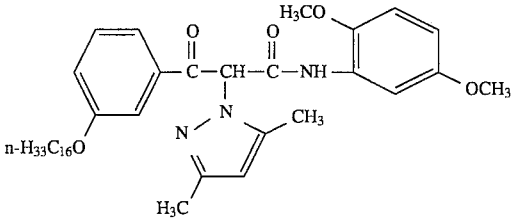
CY-36
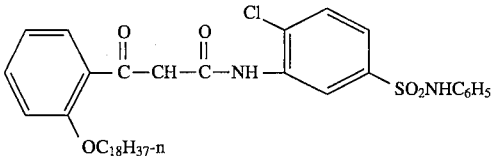
CY-37
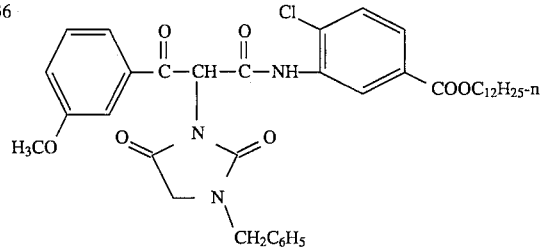
CY-38
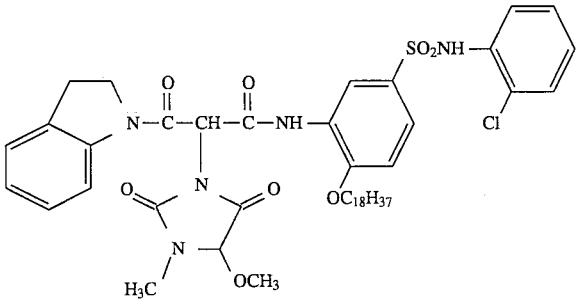
CY-39
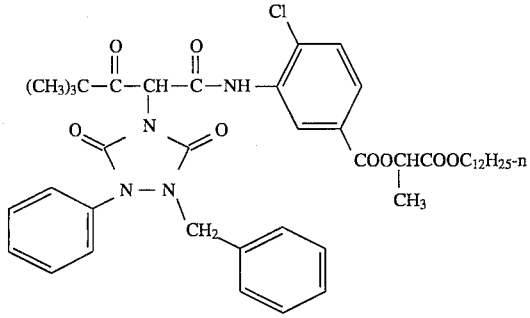
CY-40
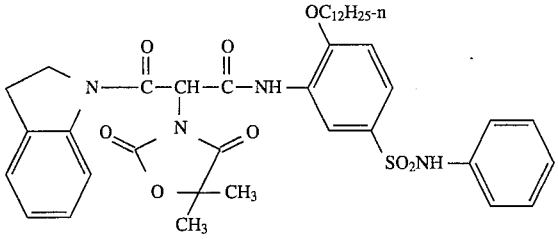

-continued

CY-41

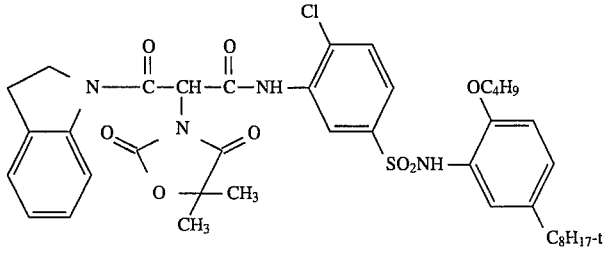

CY-42

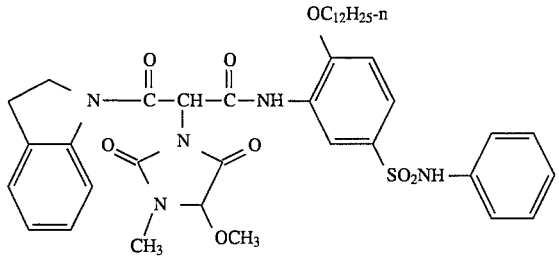

CY-43

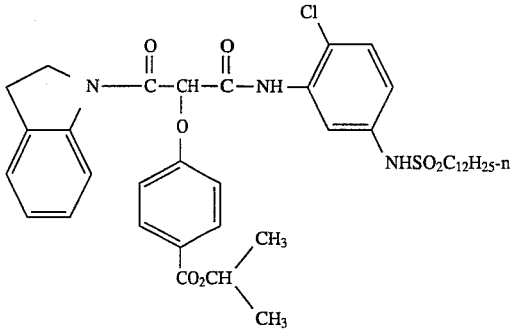

CY-44

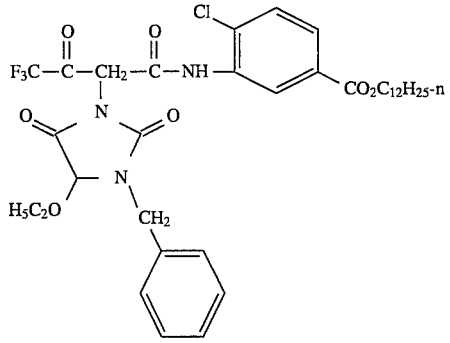

CY-45

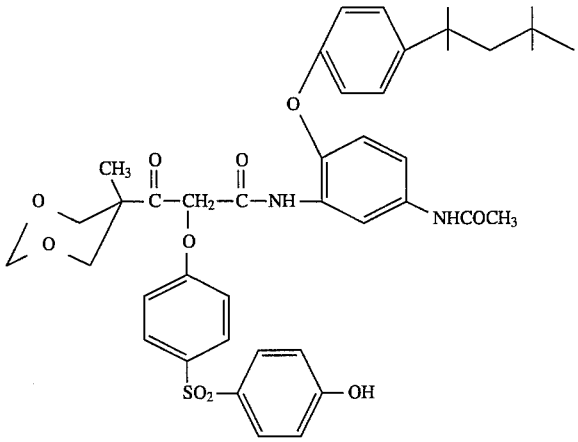

In the method of this invention surface active materials of Table I are added to a pre-formed conventional dispersion of one or more yellow couplers, as indicated above. The conventional dispersions are prepared by the methods described above, using, preferably, an anionic surface active material. Consequently, the additive of this invention is not associated with the dispersed particle surfaces but resides in the continuous phase in a dispersion or in a coating as described in FIG. 5.

Figure 5:
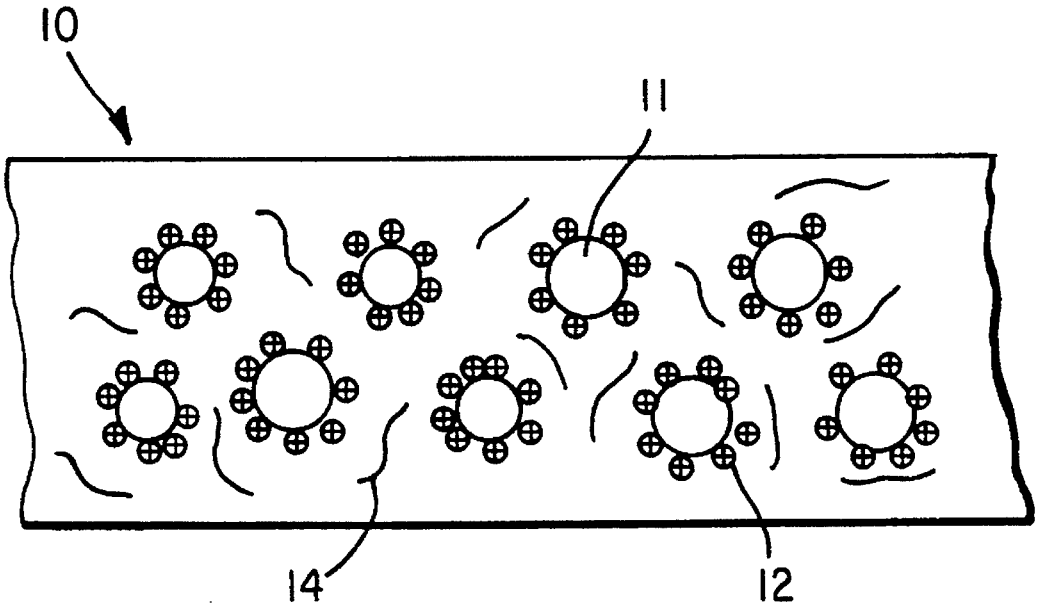
FIG. 5 shows a cross section of a layer of a photographic element containing dispersed particles of a yellow coupler with a polyoxyalkylene polymer in the continuous phase.

In FIG. 5, layer 10 of a photographic element (other layers not shown) contains dispersed particles 11 of a yellow coupler. The anionic surfactant molecules 12 used in the preparation of the dispersion is shown adhered to the surface of the dispersed coupler particles. The continuous phase in which polyoxyalkylene polymer 14 is dispersed is typically an aqueous phase containing a hydrophilic colloid, such as gelatin.

Suitable surface active polyoxyalkylene polymers and preferably block polymeric compounds containing polyoxyethylene and polyoxypropylene blocks or block polymers with multiple polyoxyethylene-polyoxypropylene blocks connected together by an organic moiety that impart high activity and high dye-stability when added to a silver halide gelatino coating melt containing conventionally predispersed PAA couplers of this invention, are given to Table I.

TABLE I

Polymeric, Block Polymeric and Block Oligomeric Addenda of this Invention

| ID | Name (Manufacturer) | Structure | Molecular Weight Range |
|---|---|---|---|
| P-1 | Pluronic ™ Polyols (BASF) | $HO-(CH_2CH_2-O)_a-(CH(CH_3)-CH_2-O)_b$ ; $H-(OCH_2-CH_2)_c$ | 1,100 to 14,000 |
| P-2 | Pluronic-R ™ Polyols (BASF) | $HO-(CH(CH_3)-CH_2-O)_a-(CH_2-CH_2-O)_b$ ; $H-(O-CH_2CH(CH_3))_c$ | 1,900 to 9,000 |
| P-3 | Plurodot ™ Polyols (BASF) | Liquid Polyethers Based on Alkoxylated Triols | 3,200 to 7,500 |
| P-4 | Tetronic ™ Polyols (BASF) | $HO-(CH_2CH_2-O)_y-(CH(CH_3)-CH_2-O)_x$ ; $HO-(CH_2CH_2-O)_y-(CH(CH_3)-CH_2-O)_x$ ; $N-CH_2$ ; $HO-(CH_2CH_2-O)_y-(CH(CH_3)-CH_2-O)_x$ ; $HO-(CH_2CH_2-O)_y-(CH(CH_3)-CH_2-O)_x$ ; $N-CH_2$ ; $HO-(CH_2CH_2-O)_y-(CH(CH_3)-CH_2-O)_x$ | 3,200 to 27,000 |
| P-5 | Plurocol E ™ | $HO-(CH_2-CH_2-O)_y-H$ | 200 to 45,000 |
| P-6 | Plurocol P ™ | $HO-(CH_2-CH(CH_3)-O)_y-H$ | 400 to 2,000 |
| P-7 | — | General Formula: $CH_3CH_2-C(CH_2O(CHCH_3CH_2O)_a(CH_2CH_2O)_oH)(CH_2O(CHCH_3CH_2O)_b(CH_2CH_2O)_pH)(CH_2O(CHCH_3CH_2O)_c(CH_2CH_2O)_qH)$ | |

| | Molecular Weight | |
|---|---|---|
| | Entire Cmpd | Polyoxypropylene Fragment |
| Compound (P-7a)(a + b + c):(o + p + q) = 1:0.43 | 4500 | 3400 |
| Compound (P-7b)(a + b + c):(o + p + q) = 1:0.25 | 4000 | 3400 |
| Compound (P-7c)(a + b + c):(o + p + q) = 1:0.10 | 4000 | 3700 |

P-8 — General Formula:

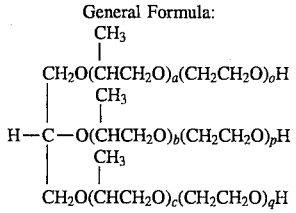

TABLE I-continued

| ID | Name (Manufacturer) | Structure | Molecular Weight: Entire Cmpd | Molecular Weight: Polyoxypropylene Fragment |
|---|---|---|---|---|
| | | Compound (P-8a)(a + b + c):(o + p + q) = 1:0.43 | 3000 | 2400 |
| | | Compound (P-8b)(a + b + c):(o + p + q) = 1:0.25 | 1500 | 1300 |
| P-9 | — | General Formula (C): 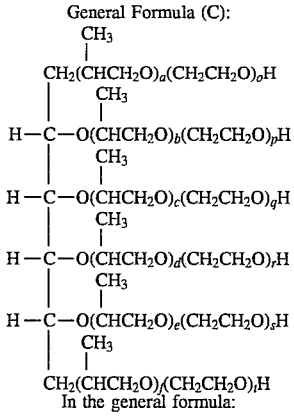 In the general formula: | | |
| | | Compound (P-9a)(a + b + c + d + e + f):(o + p + q + r + s + t) = 1:0.5 | 3000 | 2200 |
| | | Compound (P-9b)(a + b + c + d + e + f):(o + p + q + r + s + t) = 1:0.3 | 1000 | 300 |
| | | Compound (P-9c)(a + b + c + d + e + f):(o + p + q + r + s + t) = 1:0.1 | 1000 | 900 |

Other polyethylene/polypropylene block containing compounds disclosed in McCutcheon's, Vol 1, "Emulsifiers and Detergents" mention previously may be employed in this invention.

The block polymeric addenda of this invention is added to a coating melt to the extent of 0.1 to 0.6 g per gram of the PAA coupler of this invention. The preferred amount is between 0.1 to 0.3 g of the block polymeric compound per gram of the PAA coupler. The preferred block polymeric materials of this invention are (P-1) through (P-6) and most preferred is Pluronic L44 which has the following structure.

Pluronic L44

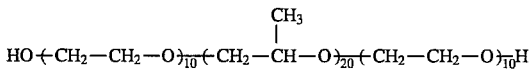

The dispersion may also contain additional compounds to further stabilize the yellow dye to the effects of heat and light. Numerous stabilizers have been disclosed in the art. Examples can be found in European patent applications Nos. 310,551 and 310,552 and U.S. Pat. Nos. 4,782,011 and 5,091,294. Polymeric stabilizers are disclosed in European patent applications Nos. 276,319 and 324,476.

Illustrative examples of suitable stabilizers for use with yellow couplers are listed below:

YS-1

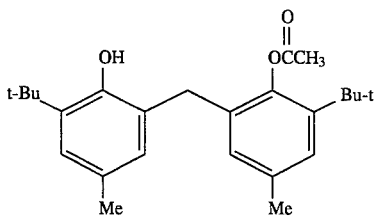

YS-2

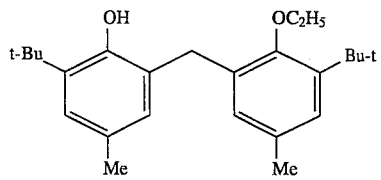

-continued
YS-3
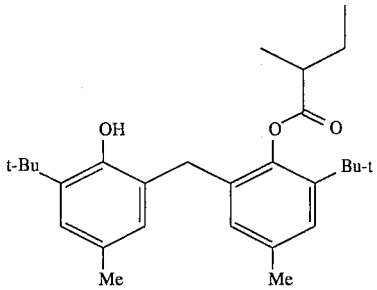
YS-4
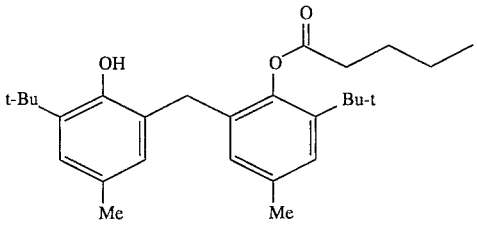
YS-5
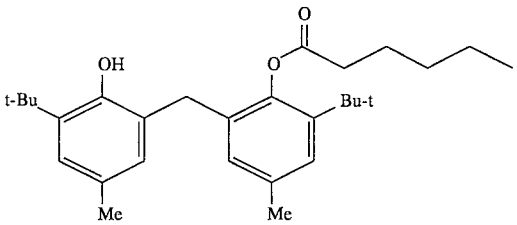
YS-6
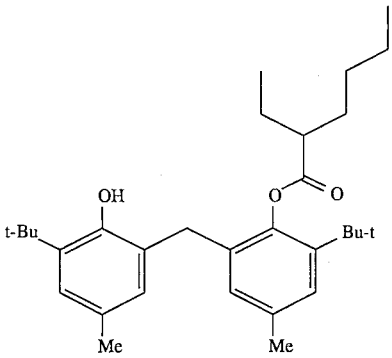
YS-7
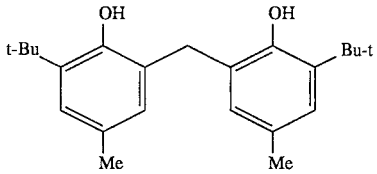
YS-8
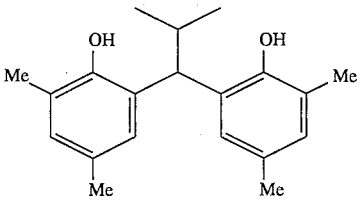
YS-9
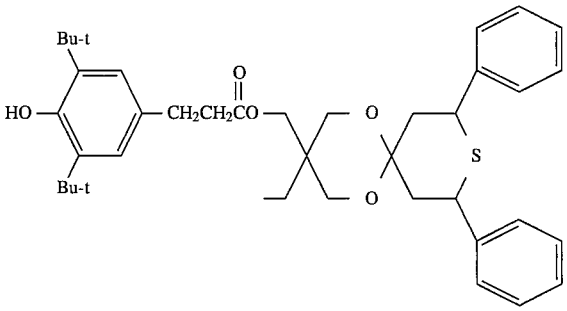
YS-10
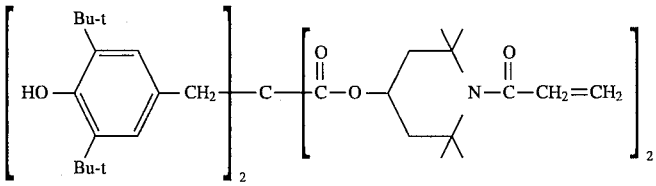
poly-t-butylacrylamide YS-11
styrene/methyl methacrylate copolymer YS-12
YS-13
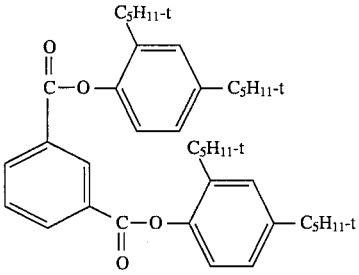
YS-14
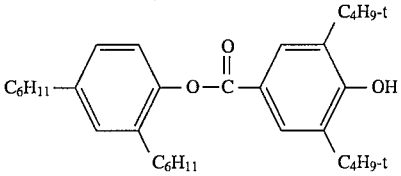

The addition of the surface active materials of this invention produce no activity advantage or dye stability advantage with other couplers. The noninventive coupler combinations with the surface active addenda of this invention exemplified hereinafter are as follows:

4-Thiopyrazolones (Magenta)

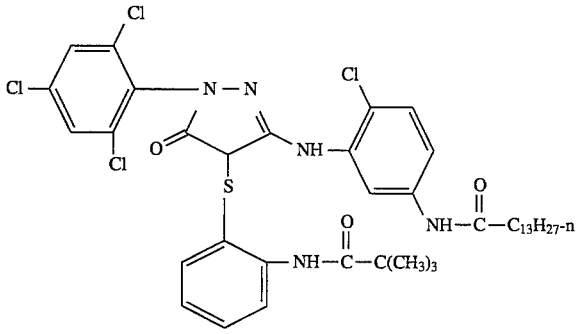

(C-1)

Pyrazolones (Magenta)

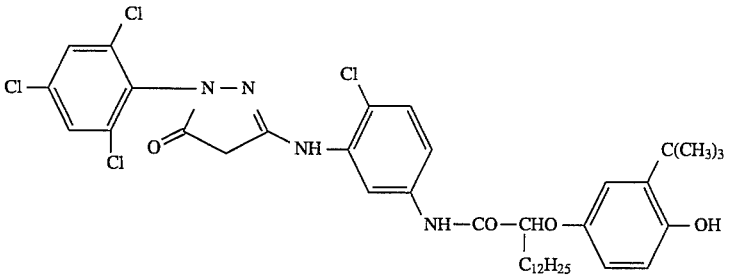

(C-2)

Phenolic (Cyan)

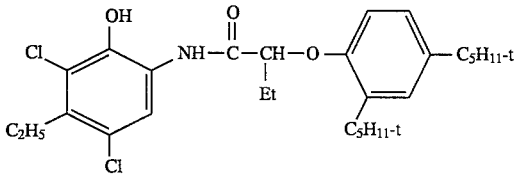

(C-3)

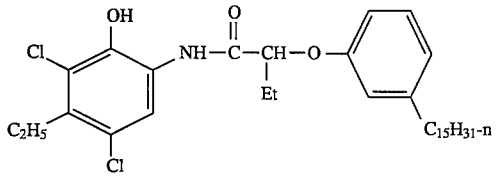

(C-4)

Not all nonionic surface active materials show this unique simultaneous effect of increased activity and added dye stability. The noninventive, nonionic surfactant used in this example is the alkyl polyglycoside (APG-225), which has the following structure.

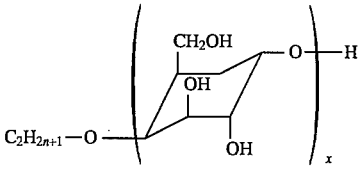

(APG 225)

The silver halide emulsions employed in the elements of this invention can be comprised of silver bromide, silver chloride, silver iodide, silver bromochloride, silver iodochloride, silver iodobromide, silver iodobromochloride or mixtures thereof. Particularly preferred are emulsions in which the silver chloride content of the grains is at least about silver chloride. The emulsions can include silver halide grains of any conventional shape or size. Specifically, the emulsions can include coarse, medium or fine silver halide grains. High aspect ratio tabular grain emulsions are specifically contemplated. The silver halide emulsions can be either monodisperse or polydisperse as precipitated. The grain size distribution of the emulsions can be controlled by silver halide grain separation techniques or by blending silver halide emulsions of differing grain sizes.

Multilayer Color Photographic Elements

The invention can be incorporated as an element in multilayer color photographic products as the yellow layer. The possible combination of couplers that may be used in combination with the inventive yellow layer in the multilayer structure is as follows:

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 40 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12*a* North Street, Emsworth, Hampshire P010 7DQ, ENGLAND.

In the following discussion of suitable materials for use in the emulsions and elements of this invention, reference will be made to *Research Disclosure,* December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,772,162, 2,895,826, 3,002,836, 3,034,892, 2,474,293, 2,423,730, 2,367,531, 3,041,236, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,600,788, 2,369,489, 2,343,703, 2,311,082, 3,152,896, 3,519,429, 3,062,653, 2,908,573 and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3 -(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl) phenoxy]acetyl]amino]-5[(2,2,3,3,4,4,4-heptafluoro-1-oxobutyl)amino]-4-hydroxyphenoxy]-2,3-dihydroxy -6-[(propylamino)carbonyl]phenyl]thio]-1,3,4-thiadiazol-2-yl]thio]-, methyl ester and "Coupler 3": 1-((dodecyloxy)carbonyl) ethyl(3-chloro-4 -((3-(2-chloro-4-((1-tridecanoylethoxy) carbonyl)anilino)-3-oxo-2-((4) (5) (6)-(phenoxycarbonyl)-1H-benzotriazol-1 -yl)propanoyl)amino)) benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino) -N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-,"Coupler 6": Carbamic acid, (6-(((3-(dodecyloxy)propyl) amino)carbonyl)-5-hydroxy-1-naphthalenyl)-, 2-methylpropyl ester , "Coupler 7": Acetic acid, ((2-((3-(((3-(dodecyloxy)propyl)amino) carbonyl)-4-hydroxy-8-(((2-methylpropoxy)carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl)azo)-5-oxo-1-(2,4,6-trichlorophenyl) -1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2 -methyl-2-propenamide; and "Coupler 10": Tetradecanamide, N-(4-chloro-3-((4-((4-((2,2'-dimethyl-1-oxopropyl)amino)phenyl)azo)-4,5-dihydro -5-oxo-1(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4-(1,1-dimethylethyl)-; Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5 -b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1Imidazolidineacetamide, N-(5-((2-(2,4-bis(1,1-dimethylpropyl)phenoxy)-1-oxobutyl)amino)-2-chlorophenyl)-.alpha.-(2,2-dimethyl -1-oxopropyl)-4-ethoxy-2,5-dioxo-3-(phenylmethyl)-.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy), 1-methylethyl ester; a mid yellow layer containing Coupler 1 and "Coupler 2": Benzoic acid, 4-chloro-3-[[2-[4-ethoxy-2,5-dioxo-3 -(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl -2-propenamide; "Coupler 4": Benzamide, 3-((2-(2,4-bis(1,1-dimethylpropyl)phenoxy)-1-oxobutyl)amino)-N-(4,5 -dihydro-5-oxo-1-(2,4,6-trichlorophenyl)-1H-pyrazol-3-yl)-; and "Coupler 5": Benzamide, 3-(((2,4-bis(1,1-dimethylpropyl)phenoxy)acetyl)amino)-N-(4,5-dihydro -5-oxo-1-(2,4,6-trichlorophenyl)-1H-pyrazol-3-yl)-; and containing the stabilizer 1,1'-Spirobis(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1 -oxobutyl)amino)-3-hydroxyphenyl)-; a mid cyan containing "Coupler 7": Butanamide, N-(4-((2-(2,4-bis(1,1-dimethylpropyl)phenoxy)-1-oxobutyl) amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1 -oxobutyl)amino)-3-hydroxyphenyl)-;

(10) one or more interlayers possibly including fine-grained nonsensitized silver halide; and

(11) an antihalation layer.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459;-4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

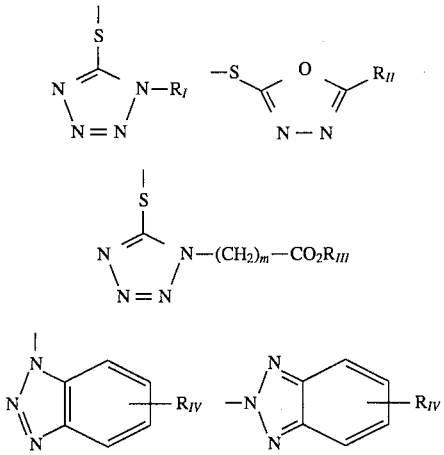

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

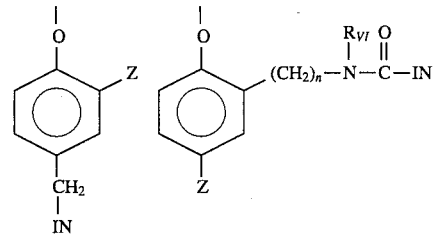

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

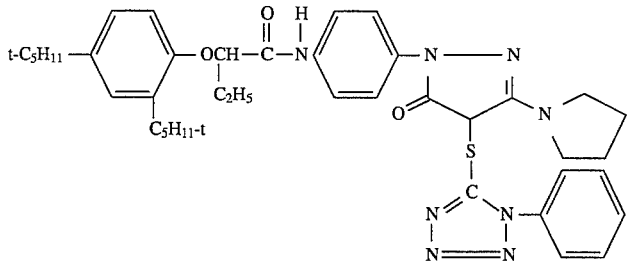

D2

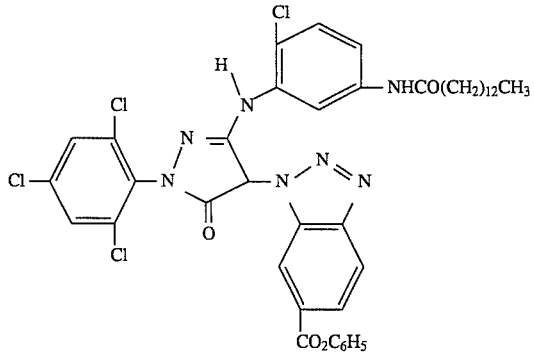

D3

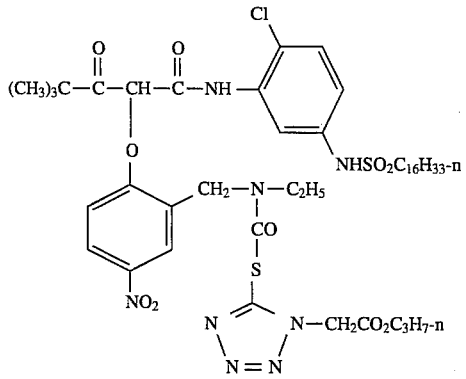

D4

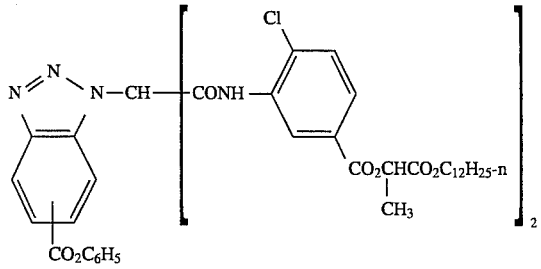

D5

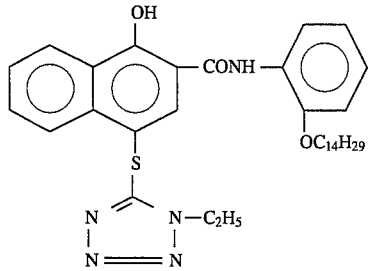

-continued
D6
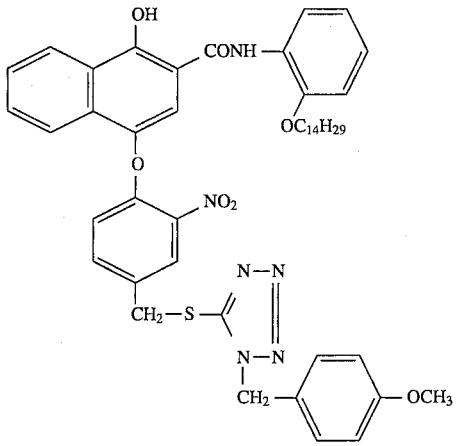
D7
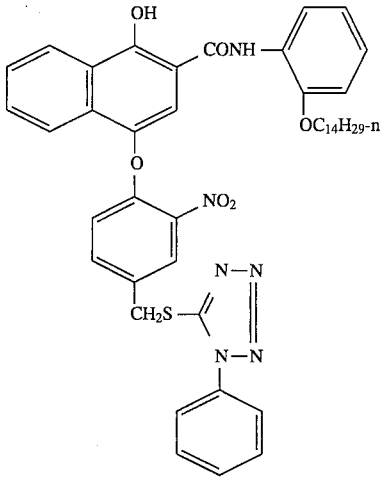
D8
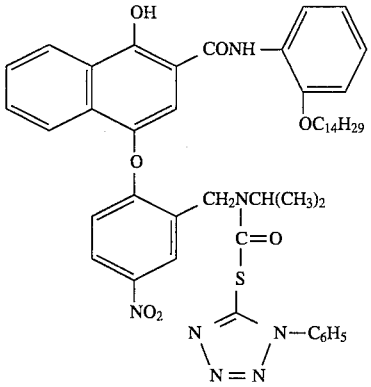

-continued

D9

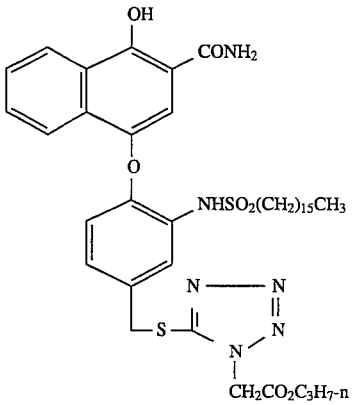

It is also contemplated that the concepts of the present invention may be employed to obtain reflection color prints as described in *Research Disclosure,* November 1979, Item 18716, available from Kenneth Mason Publications, Ltd, Dudley Annex, 12*a* North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078, 230; 90-079,336; 90-079,337; 90-079,338; 90-079,690; 90-079,691; 90-080,487; 90-080,488; 90-080,489; 90-080, 490; 90-080,491; 90-080,492; 90-080,494; 90-085,928; 90-086,669; 90-086,670; 90-087,360; 90-087,361; 90-087, 362; 90-087,363; 90-087,364; 90-088,097; 90-093,662; 90-093,663; 90-093,664; 90-093,665; 90-093,666; 90-093, 668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. In addition, use of [100] silver chloride emulsions as described in EP 534,395 is specifically contemplated.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such a the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(B-(methanesulfonamido) ethyl)aniline sesquisulfate hydrate, 4-amino-3-methyl-N-ethyl-N-(B-hydroxyethyl)aniline sulfate, 4-amino-3-B-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood throughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms.

EXAMPLES

The following examples are intended to be illustrative and not exhaustive of the invention. Parts and percentages are by weight unless otherwise specified.

Coating laydowns are given in "mg/ft$^2$". Multiplication of these numbers by 10.7 will convert them to "mg/m$^2$".

Examples 1–7

Dispersions Utilized

Conventional dispersions of the compounds indicated in Table II were prepared according to the description given earlier by the direct method for the reduction to practice of this invention. The various solvents used in preparing these dispersions are as follows:

(S-1)

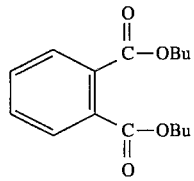

(S-2)

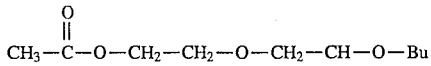

(S-3)

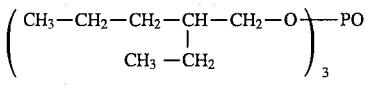

(S-4)

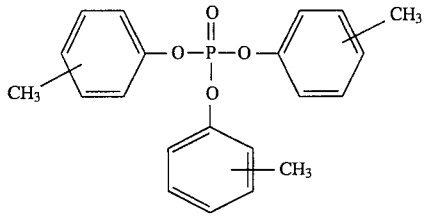

Dye stabilizers and associated scavengers used in preparation of these dispersions are as follows:

(ST-1)

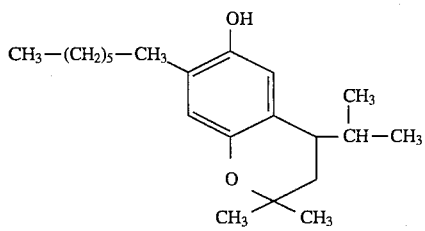

(ST-2)

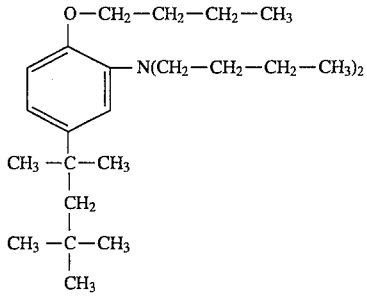

(ST-3)

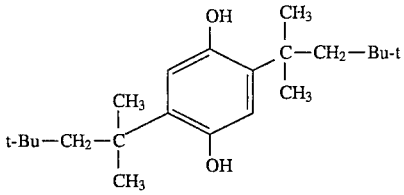

The UV-absorbing compounds used in the layers over the sensitized layers are as follows:

Tinuvin 326

(UV-1)

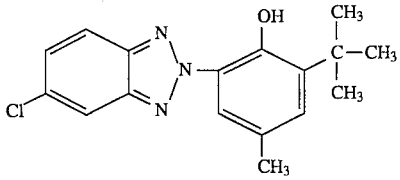

-continued

Tinuvin 328

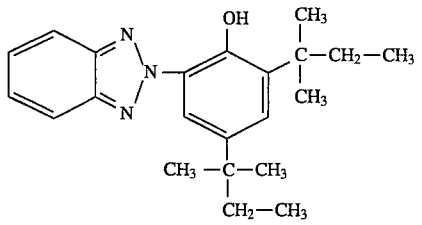

(UV-2)

Table III, that in the inventive coatings where the material of this invention, L44, was spiked in at levels of 0.2 and 0.6 g per gram of the coupler, large increases in Dmax and contrast (gradient) are shown, with other photographic parameters such as Dmin, and speed remaining the same. Such large boost in limiting reflection density levels indicate large increases in dye density yield. Extraction of the dye from the coatings and determination of their yield with a known extinction coefficient of the dye for the two invention Examples 9 and 10 are also shown in Table III in comparison with the control Example 8. It is seen that in Example 9 there

TABLE II

Compositions of Conventional Dispersions

| Example # | Coupler # or UV-Compd. | Coupler wt % | Coupler Solvent | Wt. % of Coupler Solvent | Surfactant Name | Wt. % of Surfactant | Stabilizer compound | Wt. % of Stabilizer Compound | Gelatin Wt. % | Water Wt. % |
|---|---|---|---|---|---|---|---|---|---|---|
| 1 | (CY-1) | 12.9 | (S-1) | 3.2 | (DS-A11) | 0.9 | none | none | 8.8 | 71.0 |
| | | | (S-2) | 3.2 | | | | | | |
| 2 | (CY-2) | 9.0 | (S-1) | 3.0 | (DS-A11) | 0.9 | none | none | 9.0 | 78.1 |
| 3 | (C-2) | 8.7 | (S-1) | 8.7 | (DS-A11) | 1.0 | (ST-1) | 3.7 | 8.7 | 76.3 |
| | | | | | | | (ST-3) | 0.9 | | |
| 4 | (C-1) | 6.7 | (S-3) | 4.9 | (DS-A11) | 0.9 | (ST-2) | 7.8 | 8.4 | 76.4 |
| | | | (S-4) | 2.2 | (DS-A11) | | (ST-3) | 0.7 | | |
| 5 | (C-3) | 9.5 | (S-1) | 5.2 | (DS-A11) | 0.7 | (ST-3) | 0.03 | 9.5 | 75.1 |
| | | | (S-2) | 0.8 | (DS-A11) | | | | | |
| 6 | (C-4) | 8.3 | (S-1) | 4.0 | (DS-A11) | 0.4 | none | none | 9.9 | 77.4 |
| 7 | (UV-2) | 11.8 | none | none | (DS-A11) | 0.5 | none | none | 7.8 | 77.4 |
| | (UV-1) | 2.1 | | | | | | | | |

It is to be noted that the dispersion of Example 7 does not contain any coupler solvent. The compounds (UV-1) and (UV-2) at elevated temperatures form an utectic mixture that is liquid and than can be dispersed in aqueous gelatin solution like other conventional dispersions.

Examples 8–15

Photographic Coatings and Evaluation Using PAA-Coupler (CY-1)

The coating format for testing these PAA-yellow couplers, from the base up, is as follows:

Base: Titanium dioxide loaded polyethylene resin coated photographic paper stock.

Blue Sensitized Layer: Blue sensitized cubic silver chloride emulsion with up to about 1% surface iodide having an average cubic edge length of about 0.6 microns at 30 mg/ft$^2$. Yellow dye-forming coupler (CY-1) at 100 mg/ft$^2$ dispersion of Example 1, gelatin at 115 mg/ft$^2$, added surfactant (inventive and noninventive) at 0, 0.2, and 0.6 g of coupler (CY-1).

UV-Absorbing Layer: UV-absorbing compounds (UV-2) and (UV-1) in dispersion of Example 7 at 80 mg/ft$^2$, gelatin at 121 mg/ft$^2$.

Overcoat: 125 mg/ft$^2$ of gelatin and gelatin hardener bis(vinylsulfonylmethyl)ether (BVSME) at the level of 2% based upon total gel in the packet.

In all layers the spreading agent Olin 10 G (Dixie Corporation) was used at a level of 0.3% of the melt volume of each layer.

Figure 2:
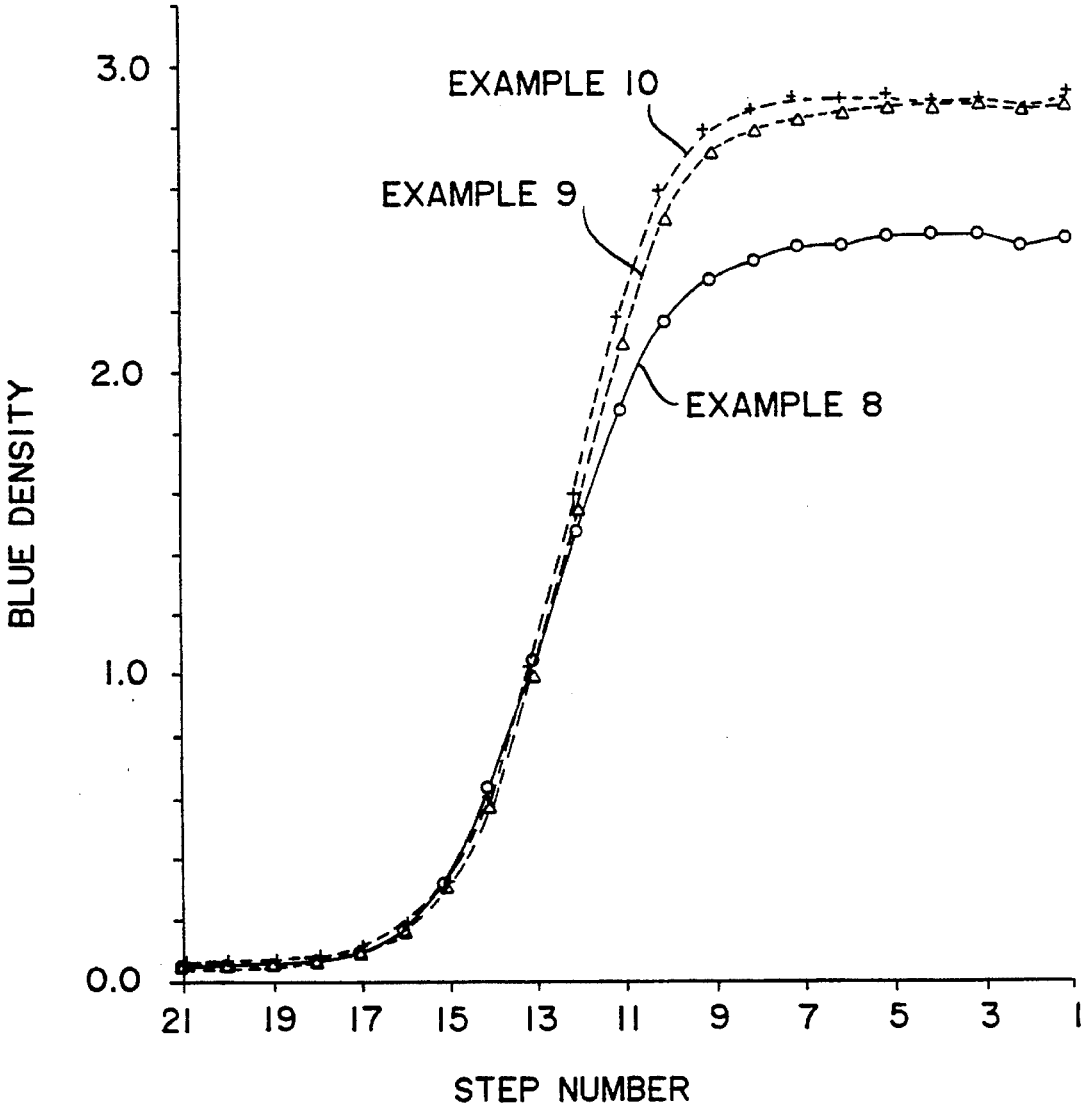
FIG. 2 is a graph of fresh sensitometric curves comparing several preparations in accordance with the invention to a control.
Figure 3:
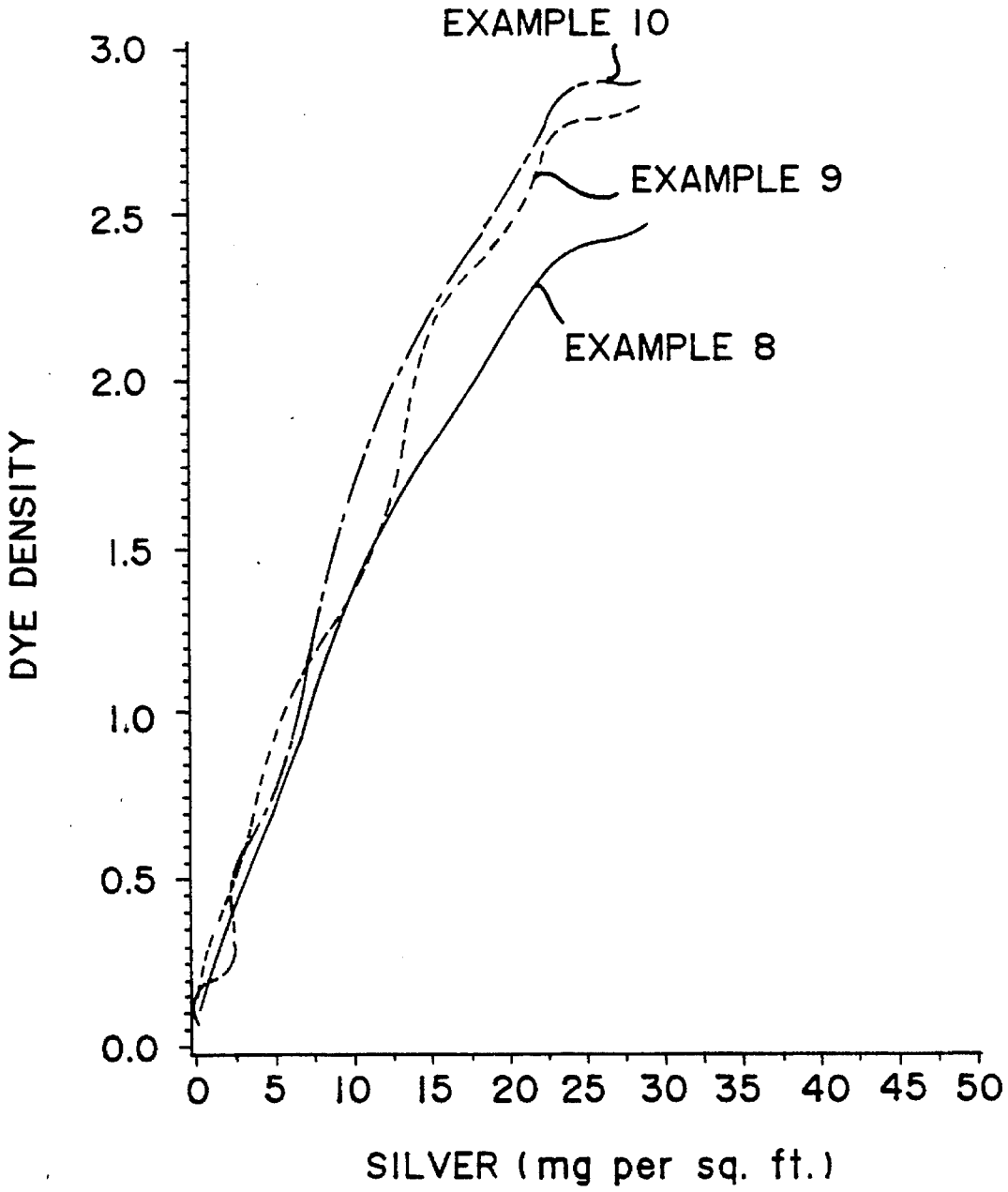
FIG. 3 is a graph of dye density vs. silver coverage comparing several preparations in accordance with the invention to a control.

The coatings were exposed to white light through a gray wedge chart and then processed by the Kodak RA-4 process (Kodak is a trademark of the Eastman Kodak Co.). The resultant image was then read by a color densitometer and the results are summarized in Table III. It is observed in is about a 46% and in Example 10 about 60% increased dye yield. The addition of L44 increased the dye yield for coupler (CY-1). APG 225 which is also a nonionic amphiphile did not show any increase in dye density (Table III). The actual sensitometric curves of the control Example 8 and the invention Examples 9 and 10 are also shown in FIG. 2, where it is seen that the spiking of L44 produces a very large boost in the Dmax of the coating of PAA coupler (CY-1). It is also seen that the boost in activity is nonlinear. That is, the major increase occurs up to a level of 0.2 g per g of coupler (CY-1) and beyond this amount the effect levels off. FIG. 3 shows plots of the dye density yield vs silver formed in the step wedge image as measured by x-ray fluorescence, after fixing out the Ag halide following the color development step. The invention examples show larger dye density for the same amount of silver developed in comparison to the control coatings.

Another advantage of this invention, is high dye stability of the formed dye image. This was demonstrated by exposing the images for 2 and 4 weeks to high intensity (50 Klux) light balanced to the color temperature of sunshine under ambient humidity and temperature conditions. The density losses measured from a density of 1.7 are also listed in Table III. It is observed that in the inventive Examples 9 and 10 where L44 was present dye density losses were considerably smaller compared to the control Example 8 and the noninventive Example 11 which contained the noninventive material APG 225. It is observed that control Example 8 did not contain any L44.

TABLE III

Fresh Sensitometry and Dye Stability Results of Photographic Coatings with PPA Coupler (CY-1)

| | Addenda | | Blue Sensitometry | | | | | | 50 K Lux Sunshine Fade from Density 1.7 | | | | Dye Yield |
|---|---|---|---|---|---|---|---|---|---|---|---|---|---|
| | | | | | | | | | 2 Week Fade | | 4 Week Fade | | |
| Example # | Name | g per g of coupler | Dmax | Dmin | Average Gradient | Speed | Dmax from Control | Gradient from Control | ΔD | Dye Stability Factor[2] | ΔD | Dye Stability Factor[2] | Micro-Mole/ft$^2$ |
| 8 | none control | 0.0 | 2.447 | 0.052 | 2.560 | 182 | 0.000 | 0.000 | −0.340 | 1.00X | −0.722 | 0.00X | 57 |
| 9 | Pluronic L44[1] inventive | 0.2 | 2.963 | 0.063 | 2.963 | 180 | 0.516 | 0.043 | −0.166 | 2.04X | −0.476 | 1.52X | 83 |
| 10 | Pluronic L44[1] inventive | 0.6 | 3.024 | 0.061 | 3.024 | 180 | 0.577 | 0.464 | −0.125 | 2.72X | −0.431 | 1.68X | 91 |
| 11 | APG non-inventive | 0.2 | 2.460 | 0.059 | 2.460 | 182 | 0.013 | −0.100 | −0.323 | 1.052X | −0.695 | 1.04X | — |

[1]Pluronic L44: $(OE)_{10}-(OP)_{20}-(OE)_{10}$ $(OE) = -(CH_2-CH_2-O)-$ $(OP) = -(CH(CH_3)-CH_2-O)-$

[2]Dye Stability Factor: Ratio of fade from density of 1.7 of example to that of the control.

In a second coating set, similar spiking experiments were done with other polyalkylene compounds such as polyethylene oxide (MW 1500), and polyalkylene block oligomers such as Pluronic P-75 and Tetronic T-304. Table IV shows that these compounds in accordance with this invention with PAA coupler (CY-1) produced increase Dmax, contrast and stability to dye fade under exposure of 50K Lux sunshine temperature balanced illumination. From the extent of the effects observed, it appears that the block polyalkylene polymers are preferred over the polyoxyethylene compound examined.

TABLE IV

Enhancement of Dmas, Gradient and Dye Stability of PAA Coupler (CY-1) by the Addition of Various Compounds of this Invention

| | Addenda | | | Increase Over | 50 K Lux Sunshine Fade from Density 1.7 | | | |
|---|---|---|---|---|---|---|---|---|
| | | | | | 2 Week Fade | | 4 Week Fade | |
| Example # | Name | g per g of Coupler | Control in Blue Dmax Dmin | Control in Blue Gradient Gradient | D | Dye Stability Factor | D | Dye Stability Factor |
| 12 | none (control) | 0.0 | 0.000 | 0.000 | −0.474 | 1.00X | −0.937 | 1.00X |
| 13 | Pluronic[1] P-75 inventive | 0.2 | 0.163 | 0.176 | −0.298 | 1.63X | −0.671 | 1.62X |
| 14 | Tetronic[2] T-304 | 0.2 | 0.244 | 0.238 | −0.271 | 1.75X | −0.602 | 1.38X |
| 15 | Polyethylene Oxide MW 1500 inventive | 0.2 | 0.074 | 0.113 | −0.369 | 1.28X | −0.796 | 1.17X |

Examples 16–17

Photographic Coatings and Evaluation Using PAA-Coupler (CY-2)

The coating format for testing yellow coupler (CY-2), from the base up, is as follows:

Base: Resin coated paper stock as described in Examples 8–15.

Blue Sensitized Layer: Blue sensitized cubic silver chloride emulsion with up to about 1% surface bromide having an average cube edge length of about 0.6 micron at 24 mg/ft$^2$, yellow dye forming coupler (CY-2) at 50 mg/ft$^2$ (dispersion of Example 2), gelatin at 115 mg/ft$^2$, added surfactant L-44 0 and 0.2 g per g of coupler (CY-2).

UV-Absorbing Layer: UV-absorbing compounds (UV-2) and (UV-1) in dispersion of Example 7 at 80 mg/ft$^2$, gelatin at 121 mg/ft$^2$.

Overcoat: 125 mg/ft$^2$ of gelatin and gelatin hardener bis(vinylsulfonylmethyl)ether (BVSME) at the level of 2% based upon total gel in the packet.

In all layers the spreading agent Olin 10 G was used at a level of 0.3% of the melt volume of each layer.

Figure 4:
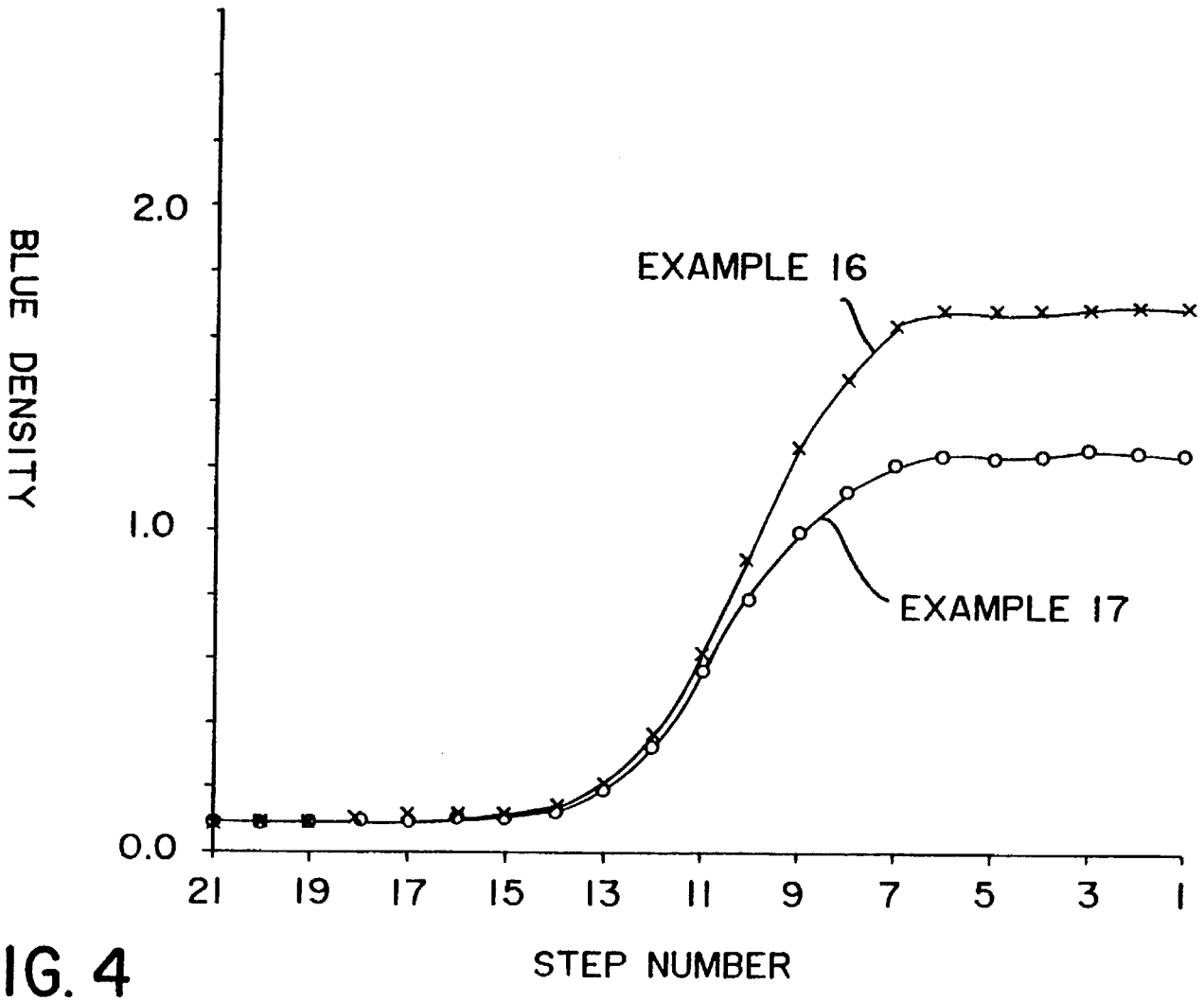
FIG. 4 is a graph of fresh sensitometric curves comparing a preparation in accordance with the invention to a control.

The coatings were exposed and processed in the same manner as indicated earlier. Results are tabulated in Table V. It clearly shows that coupler (CY-2) shows enhancement of Dmax, gradient and dye stability with the addition of the combination agent of this invention, L44, in the layer where the coupler resides. The fresh sensitometry of the coatings of Examples 16 and 17 are shown in FIG. 4.

TABLE V

Fresh Sensitometry and Dye Stability of Photographic Coating with PAA Coupler (CY-2)

| | Addenda | | Blue Sensitometry | | | | | | 50 K Lux Sunshine Fade from Density 1.0 | | | |
|---|---|---|---|---|---|---|---|---|---|---|---|---|
| | | | | | | | | | 2 Week Fade | | 4 Week Fade | |
| Example # | Name | g per g of coupler | Dmax | Dmin | Average Gradient | Speed | Dmax from Control | Gradient from Control | ΔD | Dye Stability Factor | ΔD | Dye Stability Factor |
| 16 | none control | 0.0 | 1.244 | 0.078 | 1.110 | 139 | 0.000 | 0.00 | −0.412 | 1.00X | −0.706 | 1.00X |
| 17 | Pluronic L44 inventive | 0.2 | 1.700 | 0.079 | 1.852 | 139 | 0.742 | 0.041 | −0.230 | 1.79X | −0.540 | 1.31X |

Example 18

Photographic Coating and Evaluation Using Thiopyrazolone Magenta Coupler (C-1) (Comparative)

The coating format for testing magenta coupler (C-1), from base up, is as follows:

Base: Resin coated paper stock as described in Examples 8–15.

Green Sensitized Layer: Green sensitized cubic silver chloride emulsion with up to about 1% surface bromide having an average cubic edge length of about 0.3 micron at 17 mg/ft$^2$, magenta dye-forming coupler (C-1) at 32 mg/ft$^2$, with associated image stabilizers as indicated in the dispersion of Example 4, gelatin at 115 mg/ft$^2$, added surfactant Pluronic L44 at 0, 20 and 60 mg/ft$^2$.

Overcoat: 125 mg/ft$^2$ of gelatin and gelatin and hardener BVSME at levels of 2% based upon total gel in the packet.

In all layers the spreading agent Olin 10 G was used at a level of 0.3% of the melt volume of each layer.

The coatings were exposed and processed in the same manner as indicated earlier. Sensitometric data, both fresh and after exposure to prolonged high intensity illumination, did not show any activity or dye stability advantages.

Example 19

Photographic Coatings and Evaluation Using Pyrazolone Magenta Coupler (C-2) (Comparative)

The coating format for testing magenta coupler (C-2), from base up, is as follows:

Base: Resin coated paper stock as described in Examples 8–15.

Green Sensitized Layer: Green sensitized cubic silver chloride emulsion with up to 1% surface bromide having an average cubic edge length of about 0.3 micron at 26.5 mg/ft$^2$, magenta dye-forming coupler (C-2) at 41.5 mg/ft$^2$, with associated image stabilizers as indicated in dispersion of Example 3, gelatin at 115 mg/ft$^2$, added surfactant Pluronic L44 at 0, 20 and 60 mg/ft$^2$.

UV-Absorbing Layer: UV-absorbing compounds (UV-2) and (UV-1) in dispersion of Example 7 at 80 mg/ft$^2$, gelatin at 121 mg/ft$^2$.

Overcoat: 125 mg/ft$^2$ of gelatin and hardener BVSME at levels of 2% based upon total gel in the packet.

In all layers the spreading agent Olin 10G was used at a level of 0.3% of the melt volume of each layer.

The coatings were exposed and processed in the same manner as indicated earlier. Sensitometric data, both fresh and after exposure to prolonged high intensity illumination, did not show any activity or dye stability advantages.

Example 20

Photographic Coatings and Evaluation Using Phenolic Cyan Coupler (C-3) (Comparative)

The coating format for testing cyan coupler (C-3), from base up, is as follows:

Base: Resin coated paper stock as described in Examples 8–15.

Red Sensitized Layer: Red sensitized cubic silver chloride emulsion with up to 1% surface bromide having an average cubic edge length of about 0.38 micron at 16.7 mg/ft$^2$. Cyan dye-forming coupler (C-3) at 39.3 mg/ft$^2$ as indicated in dispersion of Example 5. Gelatin at 115 mg/ft$^2$, added surfactant Pluronic L44 at 0, 20, and 60 mg/ft$^2$.

UV-Absorbing Layer: UV-absorbing compounds (UV-2) and (UV-1) in dispersion of Example 7 at 40 mg/ft$^2$, gelatin at 61 mg/ft$^2$.

Overcoat: 126 mg/ft$^2$ of gelatin and hardener BVSME at levels of 2% based upon total gel in the packet.

In all layers the spreading agent Olin 10 G was used at a level of 0.3% of the melt volume of each layer.

The coatings were exposed and processed in the same manner as indicated earlier. Sensitometric data, both fresh and after exposure to prolonged high intensity illumination did not show any activity or dye stability advantages.

Example 21

Photographic Coatings and Evaluation Using Phenolic Cyan Coupler (C-4) (Comparative)

The coating format for testing cyan coupler (C-4), from base up, is as follows:

Base: Resin coated paper stock as described in Examples 8–15.

Red Sensitive Layer: Red sensitive cubic chloride emulsion with up to 10% surface bromide having average cubic edge length of about 0.38 micron at 20 mg/ft$^2$, cyan dye-forming coupler (C-4) at 40 mg/ft$^2$ as indicated in dispersion of Example 6, gelatin at 100 mg/ft$^2$, addenda Pluronic L44 at 0, 20 and 60 mg/ft$^2$.

UV-Absorbing Layer: UV-absorbing compounds (UV-2) and (UV-1) in dispersion of Example 7 at 40 mg/ft$^2$, gelatin at 61 mg/ft$^2$.

Overcoat: 126 mg/ft$^2$ of gelatin and hardener BVSME at levels of 2% based upon total gel in the packet.

In all layers the spreading Olin 10G was used at a level of 0.3% of the melt volume of each layer.

The coatings were exposed and processed in the same manner as indicated earlier. Sensitometric data, both fresh and after exposure to prolonged high intensity illumination, did not show any activity or dye stability advantages.

A typical full multilayer photographic element in accordance with this invention has the following configuration: (Numbers indicate coverage in mg per square ft.) (Numbers within" " indicate same in mg per square meter)

LAYER 7
Overcoat:

125.0 Gelatin; "1336"
2.0 (ST-3) (Conventional Scavenger Dispersed in Solvent); "21"

LAYER-6
UV Protection Layer:

61.0 Gelatin; "653"
34.3 Tinuvin 328 (Co-dispersed) Ultraviolet light absorber; "364"
5.7 Tinuvin 326 (Co-dispersed) Ultraviolet light absorber; "60"
4.0 (ST-3) (Co-dispersed in Solvent); "43"

LAYER-5
Red Layer:

115.0 Gelatin; "1230"
39.3 (C-3) (Cyan Cplr. Co-dispersed in Solv.); "420"
0.5 (ST-3) (Scavenger Co-dispersed in Solvent); "5"
16.7 AgCl (In Red Sensitized AgCl Emulsion); "179"

LAYER-4
UV Protection Layer:

61.0 Gelatin; "653"
34.3 Tinuvin 328 (Co-dispersed); "364"
5.7 Tinuvin 326 (Co-dispersed); "60"
4.0 (ST-3) (Co-dispersed in Solvent); "43"

LAYER-3
Green Layer:

115.0 Gelatin; "1230"
41.5 (C-2) (Magenta Coupler Co-dispersed in Solvent); "444"
18.2 (ST-1) (Stabilizer Co-dispersed in Solvent); "195"
3.4 (ST-3) (Scavenger Co-dispersed in Solvent); "37"
24.5 AgCl (In Green Sensitized AgCl Emulsion); "262"

LAYER-2
Inter Layer:

70.0 Gelatin; "749"
9.0 (ST-3) (Scavenger Dispersed in Solvent); "96"

-continued

LAYER-1
Blue Layer:

140.0 Gelatin; "1498"
100.0 (CY-1) (Yellow Coupler Dispersed in Solv.); "1070"
30.0 AgCl (In Blue Sensitized AgCl Emulsion); "321"
20.0 Pluronic L-44; "214"

Resin Coat: Titanox Dispersed in Polyethylene
Support: Paper
Resin Coat: Polyethylene The invention has been described in detail with particular reference to preferred embodiments thereof, but it will be understood that variations and modifications can be effected within the spirit and scope of the invention.

What is claimed is:

1. A method of preparing a blue sensitive layer in a silver halide photographic light sensitive element, which method comprises:

(i) forming a dispersion comprising dispersed particles in an aqueous medium containing a hydrophilic colloid, the particles having a particle size of 0.1 to 0.6 μm and comprising a yellow image-dye forming coupler having the formula:

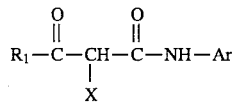

wherein $R_1$ is substituted or unsubstituted alkyl, substituted or unsubstituted aryl, substituted or unsubstituted anilino or substituted or unsubstituted heterocyclic; Ar is substituted or unsubstituted aryl; and X is hydrogen or a coupling-off group;

(ii) adding a polyoxyalkylene polymer to the dispersion formed in step (i) in an amount of about 0.1 to about 0.6 gram, per gram of the yellow coupler in the dispersion;

(iii) mixing the dispersion with a silver halide emulsion; and (iv) applying the resulting composition formed in step (iii) onto a support to form a layer.

2. The method of claim 1, wherein the polyoxyalkylene polymer is added in the the amount of from about 0.1 to about 0.3 gram per gram of yellow coupler.

3. The method of claim 1, wherein the polyoxyalkylene polymer is a polyoxyethylene-polyoxypropylene block polymer.

4. The method of claim 3, wherein the polyoxyethylene-polyoxypropylene block polymer is added in the amount of from about 0.1 to about 0.3 gram per gram of yellow coupler.

* * * * *